US009528197B2

(12) United States Patent
Naskar

(10) Patent No.: US 9,528,197 B2
(45) Date of Patent: Dec. 27, 2016

(54) CONTROLLED CHEMICAL STABILIZATION OF POLYVINYL PRECURSOR FIBER, AND HIGH STRENGTH CARBON FIBER PRODUCED THEREFROM

(71) Applicant: UT-Battelle, LLC, Oak Ridge, TN (US)

(72) Inventor: Amit K. Naskar, Knoxville, TN (US)

(73) Assignee: UT-BATTELLE, LLC, Oak Ridge, TN (US)

( * ) Notice: Subject to any disclaimer, the term of this patent is extended or adjusted under 35 U.S.C. 154(b) by 656 days.

(21) Appl. No.: 13/860,188

(22) Filed: Apr. 10, 2013

(65) Prior Publication Data

US 2014/0306364 A1 Oct. 16, 2014

(51) Int. Cl.

*D01F 9/21* (2006.01)
*D01F 9/20* (2006.01)
*D01F 9/12* (2006.01)

(52) U.S. Cl.

CPC . *D01F 9/21* (2013.01); *D01F 9/12* (2013.01); *D01F 9/20* (2013.01)

(58) Field of Classification Search

CPC ..... C01B 31/02; D01F 9/12; D01F 9/145; D01F 9/22; D01F 9/00; D01F 9/127; D01F 9/1277; D01F 9/133; D01F 9/24; D01F 9/328; D01F 9/21; B28Y 30/00; C04B 35/83; C08K 5/23

USPC ..... 264/29.1–29.7, DIG. 19, 627, 639, 640, 264/641, 211.14, 211.22, DIG. 26, DIG. 75; 423/447.1, 447.2, 447.8, 447.3, 423/447.4, 447.6, 447.7, 447.9, 447.5, 423/448, 449.1, 449.2, 449.3, 449.4; 425/DIG. 17, 72.1, 425/72.2, 66

See application file for complete search history.

(56) References Cited

U.S. PATENT DOCUMENTS 4,070,446 A 1/1978 Horikiri et al.
7,749,479 B2 7/2010 Leon y Leon
8,221,840 B2 * 7/2012 Sugiura ..... C08J 5/06 423/447.1

(Continued)

FOREIGN PATENT DOCUMENTS

WO WO 92/03601 3/1992

OTHER PUBLICATIONS

NPL-1. On the Critical Temperature, Normal Boiling Point, and Vapor Pressure of Ionic Liquids. Lius Rebelo. Mar. 12, 2005. The Journal of Physical Chemistry B Letters. 109. 6040-6043.*

(Continued)

*Primary Examiner* — James Sanders
*Assistant Examiner* — Leith S Shafi
(74) *Attorney, Agent, or Firm* — Scully Scott Murphy & Presser

(57) ABSTRACT

Method for the preparation of carbon fiber, which comprises: (i) immersing functionalized polyvinyl precursor fiber into a liquid solution having a boiling point of at least 60° C.; (ii) heating the liquid solution to a first temperature of at least 25° C. at which the functionalized precursor fiber engages in an elimination-addition equilibrium while a tension of at least 0.1 MPa is applied to the fiber; (iii) gradually raising the first temperature to a final temperature that is at least 20° C. above the first temperature and up to the boiling point of the liquid solution for sufficient time to convert the functionalized precursor fiber to a pre-carbonized fiber; and (iv) subjecting the pre-carbonized fiber produced according to step (iii) to high temperature carbonization conditions to produce the final carbon fiber. Articles and devices containing the fibers, including woven and non-woven mats or paper forms of the fibers, are also described.

34 Claims, 12 Drawing Sheets

(56) References Cited

U.S. PATENT DOCUMENTS

| | | | | |
|---|---|---|---|---|
| 2012/0027944 | A1* | 2/2012 | Yu | B82Y 30/00 427/462 |
| 2013/0084455 | A1 | 4/2013 | Naskar et al. | |
| 2015/0152574 | A1* | 6/2015 | Barton | D01F 9/21 423/447.2 |
| 2015/0167201 | A1* | 6/2015 | Barton | D01F 9/14 423/447.2 |

OTHER PUBLICATIONS

NPL-2. Karacan et al. Use of Sulfonation Procedure for the Development of Thermally Stabilized Isotactic Polypropylene Fibers Prior to Carbonization. Jul. 26, 2011. Journal of Applied Polymer Science. vol. 123, 234-245.*

Leon y Leon C.A. et al., "Low Cost Carbon Fiber from Non-Acrylic Based Precursors: Polyethylene", 34th International SAMPE Technical Conference, pp. 506-519 (Nov. 4-7, 2002), together with an English-language abstract.

Penning J.P. et al., "The Effect of Diameter on the Mechanical Properties of Amorphous Carbon Fibres from Linear Low Density Polyethylene", Polymer Bulletin 25:405-412 (1991).

Postema A.R. et al., "Amorphous Carbon Fibres from Linear Low Density Polyethylene", Journal of Materials Science 25:4216-4222 (1990).

Zhang D. et al., "Structure and Properties Development During the Conversion of Polyethylene Precursors to Carbon Fibers", Journal of Applied Polymer Science 62:367-373 (1996).

* cited by examiner (10A)

(10B)

CONTROLLED CHEMICAL STABILIZATION OF POLYVINYL PRECURSOR FIBER, AND HIGH STRENGTH CARBON FIBER PRODUCED THEREFROM

This invention was made with government support under Prime Contract No. DE-AC05-00OR22725 awarded by the U.S. Department of Energy. The government has certain rights in the invention.

FIELD OF THE INVENTION

The present invention relates, generally, to methods for producing carbon fiber, and more particularly, to such methods wherein a chemical stabilization process is used prior to carbonization of a polyvinyl precursor fiber.

BACKGROUND OF THE INVENTION

Carbon fiber is known to be produced from polyethylene fiber by first stabilizing the precursor fiber by liquid immersion sulfonation (e.g., by treatment with chlorosulfonic or sulfuric acid) to make an infusible precursor, and the infusible precursor subjected to pyrolysis to make the carbon fiber. Without the stabilization process, the polyethylene fiber would not be thermally infusible, and therefore, not carbonizable at the high temperatures employed for carbonization.

Rapid stabilization via sulfonation of polyethylene precursor fibers is desired for favorable process economics. However, a key problem encountered in the rapid-stabilization process is that the resulting carbon fiber often lacks sufficient strength and other mechanical properties (more specifically, adequate tensile strength and elastic modulus) for applications in which such robust characteristics are needed. Thus, there would be a clear and present advantage in an improved stabilization method that results in higher strength and more robust carbon fibers.

Polymeric fibers with high degree of molecular orientation have high tensile strength and modulus. Sulfonation of polyethylene causes shrinkage in the fiber, with more rapid sulfonation causing a higher degree of fiber shrinkage. The shrinkage force due to sulfonation is substantial for highly oriented fibers, and high orientation imparts more tolerance to shrinkage force. Therefore, a combination of all these would be necessary to attain a preferred fiber morphology via a directed alteration of process sequence that leads to precursor and precursor-derived carbon with long-range order.

SUMMARY OF THE INVENTION

The instant invention is directed to an improved chemical stabilization process of polyolefin and chemically related (i.e., polyvinyl) fibers that results in carbon fibers of significantly improved mechanical characteristics, particularly tensile strength, elastic modulus, and ultimate elongation. The process described herein achieves this by carefully controlling the stabilization conditions in a manner that results in a highly ordered pre-carbonized fiber. In specific embodiments, the method involves the stabilization of carbon-precursor fiber from a functionalized polyvinyl precursor fiber having thermally labile groups thereon. In some embodiments, the functionalized polyvinyl precursor fiber is a sulfonated polyethylene fiber wherein the thermally labile groups include sulfonic acid groups. The pre-carbonized fiber formed at the end of the stabilization process, however, does not retain a significant concentration of the thermally labile groups covalently bonded to the precursor macromolecule. Thus, the method involves a functionalization and defunctionalization equilibrium that leads to a pre-carbonized derivative.

In specific embodiments, a high degree of order is provided to the pre-carbonized fiber by maintaining an applied tension on the fiber during the stabilization process. The pre-carbonized fiber is then subjected to high temperature carbonization conditions to produce an ordered carbon fiber of improved strength and modulus. Without being bound by theory, it is believed that the highly ordered nature of the pre-carbonized fiber is primarily responsible for the improved characteristics of the carbon fiber.

In particular embodiments, the invention is practiced by: (i) immersing functionalized polyvinyl precursor fiber into a liquid solution having a boiling point of at least 60° C., wherein the liquid solution includes a solvent and a dissolved solute that can engage in an elimination-addition reaction equilibrium with said thermally labile groups; (ii) heating the liquid solution, either before or after the functionalized polyvinyl precursor fiber has been immersed therein, to a first temperature of at least 25° C. at which the functionalized polyvinyl precursor fiber engages in the elimination-addition equilibrium while the functionalized polyvinyl precursor fiber is maintained at an applied tension of at least 0.1 MPa; (iii) gradually raising the first temperature to a final temperature at an average temperature ramp rate of up to 50° C. per minute, wherein the final temperature is at least 20° C. above the first temperature and up to the boiling point of the liquid solution for sufficient time to convert the functionalized polyvinyl precursor fiber to a pre-carbonized fiber; and (iv) subjecting the pre-carbonized fiber produced according to step (iii) to high temperature carbonization conditions to produce the carbon fiber, wherein the high temperature carbonization process is conducted at a temperature of at least 400° C.

In some embodiments, the precursor fibers are activated by free radical generating agents, such as initiators and/or radiation, which permit room temperature functionalization in the presence of the reactant solutes in a solvent. In other embodiments, the precursor fibers are stretched and heat set at a specific temperature to gain dimensional stability through re-crystallization under oriented condition. Then the fibers do not exhibit severe shrinkage force during functionalization, and thus, such fibers can be processed at minimal axial stress (e.g., 0.1 MPa).

The invention is also directed to articles and devices in which the resulting carbon fibers can be incorporated, as well as methods for producing and using such articles and devices. The resulting carbon fiber can be used as, or incorporated into, any suitable material or device for any suitable application, such as in rugged functional or structural materials (e.g., carbon fiber composites for use in, e.g., automobile frames or interior, armor, protective gear, such as helmets), water filtration and purification materials and devices, gas adsorption materials, gas separation materials, water desalination materials, charge storage materials, electrochemical materials (e.g., electrodes), smoke reduction or removal materials, and catalyst support materials. The invention is also directed to fabric and textile materials in which the pre-carbonized fiber or final carbon fiber are incorporated, wherein the fabric or textile can be a woven or non-woven mat or paper made of the pre-carbonized fiber or final carbon fiber either in the absence or presence of non-carbon fiber. The fabric or textile material can be used in any suitable application, such as those described above, either by itself or in a composite form with another material.

DETAILED DESCRIPTION OF THE INVENTION

Figure 1:
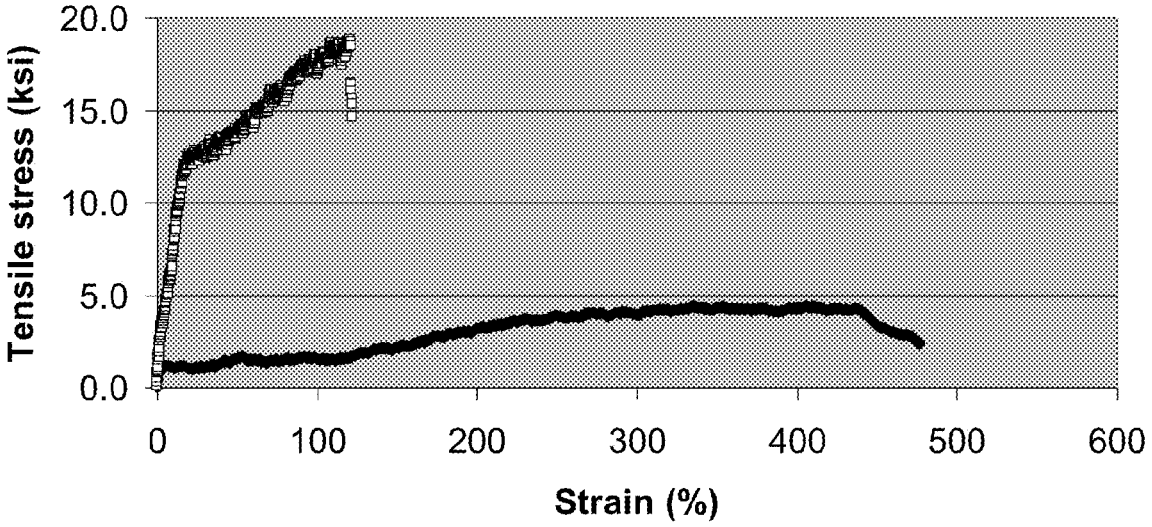
FIG. 1. Graph showing tensile stress-strain profiles of homocomponent spun-drawn fiber (Sample 1, diameter 18 micrometer, exhibiting 100-150% ultimate elongation) and bicomponent extruded mostly undrawn fiber (Sample 2, diameter 10 micrometer, exhibiting greater than 450% ultimate elongation).

As used herein, the term "about" generally indicates within ±0.5, 1, 2, 5, or 10% of the indicated value. For example, in its broadest sense, the phrase "about 20 μm" can mean 20 μm±10%, which indicates 20±2 μm or 18-22 μm.

The invention is foremost directed to a method for preparing a high strength carbon fiber by subjecting a functionalized precursor polyvinyl fiber (functionalized precursor fiber) having thermally labile groups thereon to a controlled chemical stabilization process. The controlled chemical stabilization process entails immersing the functionalized precursor polyvinyl fiber into a liquid solution at an elevated temperature at which the thermally labile groups on the polyvinyl fiber engage in an elimination-addition reaction equilibrium with the liquid (stabilization) solution while the functionalized precursor polyvinyl fiber is maintained at an applied tension. In the method, the functionalized precursor fiber is placed in the stabilization solution that is held at a first temperature at which the elimination-addition equilibrium occurs; the temperature of the stabilization solution is then gradually raised to a final temperature at which the functionalized precursor fiber is converted to a pre-carbonized fiber. The phrase "maintained at an applied tension" means that, during at least a portion of the period of time (for example, at least 50%, 60%, 70%, 80%, 90%, or 100% of the period of time) from the first temperature to the final temperature, the functionalized precursor fiber is subjected to an applied tension, whether the applied tension be held at a specified tension value or varied during this period of time. The resulting pre-carbonized fiber is then subjected to high temperature carbonization conditions, such as those known in the art, to produce the final high strength carbon fiber. Such high temperature carbonization process usually applies tension to the carbonizing filaments of precursors.

The applied tension is typically at least 0.1 or 0.2 MPa. In different embodiments, the applied tension is precisely, about, at least, above, up to, or less than, for example, 0.3, 0.5, 0.8, 1, 2, 3, 4, 5, 6, 7, 8, 9, 10, 12, or 15 MPa. The maximum amount of tension being applied to the fiber is necessarily dependent on the break strength of the fiber. In some embodiments, the tension is also applied before the fiber reaches the first temperature and/or after the fiber reaches the final temperature. The fiber may or may not also be held under tension during the high temperature carbonization step. In some embodiments, the applied tension is maintained at precisely or about a certain value between different temperature points, or between isothermal time points, or throughout the stabilization process, and optionally through the carbonization process. In other embodiments, the applied tension is varied between different temperature points or between isothermal time points, particularly a gradual increase in tension or a gradual decrease in tension, wherein the initial and final tension values can be selected from any of the exemplary values provided above.

The term "pre-carbonized" means that at least a portion of the functionalized precursor fiber (e.g., in wt %) is converted to "defunctionalized" fiber where the elemental carbon content is higher than the original precursor. By being "pre-carbonized", the functionalized precursor fiber may be about, at least, or above, for example, 20, 25, 30, 35, 40, 50, 60, 70, 80, 85, 90, or 95 wt % elemental carbon, or a weight percent within a range bounded by any of the foregoing values. Above the first temperature and up to or at the final temperature, at least some portion of the functionalized precursor fiber is pre-carbonized, which may correspond to any of the weight percents of elemental carbon provided above. After sulfonation of PE, polyvinyl sulfonic acid derivatives can be produced at a maximum possible degree of sulfonation, e.g., where alternate carbon atoms in the PE macromolecule chain becomes sulfonated. Such a material has a carbon content of about 22 wt %. After the treatment in the stabilizing bath (e.g., sulfonating bath) at a temperature above 25° C., some of the thermally labile groups (e.g., sulfonic acids) are eliminated to produce a carbon rich alkene derivative. In this way, the carbon content becomes enhanced. Such unsaturated moieties can undergo non-free radical sulfonation, such as electrophilic sulfonation, to reproduce the sulfonated derivative. However, under a free-radical rich environment (e.g., by conc. sulfuric acid or $SO_3$-containing fuming sulfuric acid) sulfonation can occur at saturated carbon sites of the hydrocarbon. The desulfonation-sulfonation equilibrium continues until the material is converted to a highly unsaturated hydrocarbon. One extreme case of highly unsaturated hydrocarbon is polyacetylene, which is 92.3 wt % carbon. Such a material is herein referred to as a 'pre-carbonized' derivative, as a further increase in temperature can cause elimination of hydrogen and formation of graphitizable carbon. In some embodiments, a "pre-carbonization" step includes that at least a portion of the precursor fiber (e.g., in wt %) is converted to elemental carbon by the elimination of hydrogen and formation of graphitizable carbon. The pre-carbonized fiber can typically be up to 95 wt % carbon.

The completely pre-carbonized fiber should have the property of being infusible, i.e., will not melt, difficult to combust, or catch fire during the high temperature carbonization process under inert atmosphere. Without being bound by theory, it is believed that the pre-carbonized fiber contains a highly unsaturated polymer structure with rigid domains of conjugated liquid crystalline structural units, all of which contribute to its infusible nature and seed the possibility of gaining long-range order that is absolutely necessary for high strength carbon fibers.

Generally, at the first temperature, no portion (i.e., 0 wt %) of the functionalized precursor fiber is converted to a carbon rich moiety, such as unsaturated hydrocarbon segments. Perhaps up to or less than 1, 2, or 5 mol % of a sulfonated polyolefin can get desulfonated.

The polyvinyl precursor fiber having thermally labile groups thereon can be any vinyl addition polymer having such groups. In one instance, the thermally labile groups are included by the addition polymerization of vinyl monomers containing such labile groups. In another instance, the thermally labile groups are included by treating a vinyl polymer or saturated hydrocarbon polymer fiber under conditions that incorporate such labile groups. The thermally labile group generally includes one or more heteroatoms (i.e., other than carbon and hydrogen) and has the characteristic of undergoing an elimination-addition (i.e., dissociation-association) equilibrium with the polymer backbone at a certain elevated temperature. Those heteroatoms are typically electronegative atoms. The elimination is believed to involve formation of an unsaturated bond in the polymer, while the addition is believed to add the labile groups to an unsaturated carbon bond. As the temperature is elevated into the pre-carbonization zone, the dissociation process begins to outweigh the association process, thereby tilting the equilibrium toward formation of a carbon rich polymer, or pre-carbonization of the polymer. Some examples of thermally labile groups include halogen atoms (e.g., fluoro, chloro, bromo, and iodo atoms), sulfur-containing groups (e.g., sulfate, sulfonate, thiol, and disulfide groups), oxygen-containing groups (e.g., hydroxy, alkoxy, ester), and nitro groups. Some examples of functionalized polyvinyl precursors include sulfonated polyolefins (e.g., sulfonated polyethylene or polypropylene), polyvinylchloride (PVC), polyvinyl sulfate, polyvinyl alcohol, polyvinyl acetate, and partially hydrolyzed polyvinyl acetate.

The liquid solution (i.e., "stabilization solution") in which the functionalized precursor fiber is immersed contains at least a solvent and a dissolved solute that can engage in the above-described elimination-addition equilibrium. The boiling point of the stabilization solution is preferably at least 60° C., 70° C., or 80° C. In different embodiments, depending primarily on the nature of the solvent and solute, the boiling point of the stabilization solution is precisely, about, at least, above, up to, or less than, for example, 90° C., 95° C., 100° C., 105° C., 110° C., 115° C., 120° C., 125° C., 130° C., 135° C., 140° C., 145° C., 150° C., 155° C., 160° C., 165° C., 170° C., 175° C., 180° C., 185° C., 190° C., 195° C., 200° C., 205° C., 210° C., 220° C., 230° C., 240° C., 250° C., 260° C., 270° C., 280° C., 290° C., 300° C., 310° C., 320° C., 330° C., 340° C., 350° C., 360° C., 370° C., 380° C., 390° C., 400° C., 410° C., 420° C., 430° C., 440° C., or 450° C., or the boiling point may be within a range bounded by any two of the foregoing values. The boiling point of the solvent may be lower than the boiling point of the solution, since the solute may either raise or lower the boiling point.

The solvent of the stabilization solution can be any one or more solvents known in the art. In some embodiments, a single solvent is used, whereas in other embodiments, a mixture of two or more solvents is used, generally in a single phase. The boiling point of the solvent or mixture of solvents can be any of the boiling points provided above for the solution, or a boiling point lower than provided above, e.g., at least or above about 70° C., 60° C., 50° C., or 40° C. In a first embodiment, the solvent is a polar protic liquid. Some examples of polar protic liquids include water, the alcohols (e.g., methanol, ethanol, isopropanol, n-butanol, t-butanol, the pentanols, hexanols, octanols, or the like), diols (e.g., ethylene glycol, diethylene glycol, triethylene glycol), and protic amines (e.g., ethylenediamine, ethanolamine, diethanolamine, and triethanolamine). In a second embodiment, the solvent is a polar non-protic liquid. Some examples of polar non-protic liquids include the nitriles (e.g., acetonitrile, propionitrile), sulfoxides (e.g., dimethylsulfoxide), amides (e.g., dimethylformamide, N,N-dimethylacetamide), sulfonamide (e.g., n-butyl benzenesulfonamide), organochlorides (e.g., methylene chloride, chloroform, 1,1,-trichloroethane), ketones (e.g., acetone, 2-butanone), dialkylcarbonates (e.g., ethylene carbonate, dimethylcarbonate, diethylcarbonate), organoethers (e.g., tetrahydrofuran and dioxane), hexamethylphosphoramide (HMPA), N-methylpyrrolidone (NMP), 1,3-dimethyl-3,4,5,6-tetrahydro-2(1H)-pyrimidinone (DMPU), and propylene glycol methyl ether acetate (PGMEA). A mixture of any of the foregoing solvents may also be used, if applicable. In particular embodiments, an aqueous solution is used, which may contain only water as a solvent, or water in admixture with one or more water-soluble solvents. In other embodiments, one or more of the above general classes or specific types of solvents is excluded from the stabilization solution.

In some embodiments, the solvents can have high boiling points of at least or above 350 or 400° C., such as an ionic liquid solvent. Such high-boiling solvents allow for a significant degree of carbonization. Thus, by use of a high boiling solvent, the elimination-addition equilibrium can be directly shifted from precarbonization to low-temperature carbonization.

The ionic liquid can be any organic or inorganic ionic liquid known in the art. The ionic liquid can be of the formula $Y^+X^-$, wherein $Y^+$ is a cationic component of the ionic liquid and $X^-$ is an anionic component of the ionic liquid. The formula $(Y^+)(X^-)$ is meant to encompass a cationic component $(Y^+)$ having any valency of positive charge, and an anionic component $(X^-)$ having any valency of negative charge, provided that the charge contributions from the cationic portion and anionic portion are counterbalanced in order for charge neutrality to be preserved in the ionic liquid molecule. More specifically, the formula $(Y^+)(X^-)$ is meant to encompass the more generic formula $(Y^{+a})_y(X^{-b})_x$, wherein the variables a and b are, independently, non-zero integers, and the subscript variables x and y are, independently, non-zero integers, such that a.y=b.x (wherein the period placed between variables indicates multiplication of the variables). The foregoing generic formula encompasses numerous possible sub-formulas, such as, for example, $(Y^+)(X^-)$, $(Y^{+2})(X^-)_2$, $(Y^+)_2(X^{-2})_2$, $(Y^{+2})_2(X^{-2})_2$, $(Y^{+3})(X^{-2})_3$, $(Y^+)_3(X^{-3})$, $(Y^{+3})_2(X^{-2})_3$, and $(Y^{+2})_3(X^{-3})_2$. In some embodiments, $Y^+$ can be an inorganic species, while in other embodiments, $Y^+$ is an organic species.

The ionic liquid is typically a liquid at room temperature (e.g., 15, 18, 20, 22, 25, or 30° C.) or lower. However, in some embodiments, the ionic liquid may become a liquid at a higher temperature than 30° C. if it is used at an elevated temperature that melts the ionic liquid. Thus, in some embodiments, the ionic liquid may have a melting point of up to or less than 100, 90, 80, 70, 60, 50, 40, or 30° C. In other embodiments, the ionic liquid is a liquid at or below 10, 5, 0, −10, −20, −30, or −40° C. The ionic liquid may also have any suitable boiling point, particularly a high boiling point, such as at least 350, 400, 450, or 500° C.

In particular embodiments, the cationic portion $(Y^+)$ of the ionic liquid $Y^+X^-$ is an ammonium species. In some embodiments, the ammonium cation portion includes a heterocyclic ring having a positively-charged ring nitrogen atom. The heterocyclic ring having a positively-charged ring nitrogen atom can be monocyclic, bicyclic, tricyclic, or a higher cyclic (polycyclic) ring system. Some examples of a heterocyclic ring having a positively-charged ring nitrogen atom include imidazolium, pyridinium, pyrazinium, pyrrolidinium, piperidinium, piperazinium, morpholinium, pyrrolium, pyrazolium, pyrimidinium, triazolium, oxazolium, thiazolium, triazinium, and cyclic guanidinium rings. Any of the foregoing cationic rings may be bound or fused with one or more other saturated or unsaturated (e.g., aromatic) rings, such as a benzene, cyclohexane, cyclohexene, pyridine, pyrazine, pyrrolidine, piperidine, piperazine, pyrrole, pyrazole, pyrimidine, or indole rings. Some examples of fused charged rings include benzimidazolium, pyrrolo[1,2-a]pyrimidinium, indolium, quinolinium, quinazolinium, quinoxalinium, 5,6,7,8-tetrahydroimidazo[1,2-a]pyridine, and H-imidazo[1,2-a]pyridine. Ionic liquids containing any of the foregoing cationic components are either commercially available or can be synthesized by procedures well-known in the art, as evidenced by, for example, T. L. Greaves, et al., "Protic Ionic Liquids: Properties and Applications", *Chem. Rev.,* 108, pp. 206-237 (2008), the contents of which are herein incorporated by reference in their entirety. Any of the ionic liquids described in the foregoing reference may be used herein.

Some exemplary imidazolium-based ionic liquids include 1,3-dimethylimidazolium$^+X^-$, 1,2,3-trimethylimidazolium$^+X^-$, 2-ethyl-1,3-dimethylimidazolium$^+X^-$, 2-n-propyl-1,3-dimethylimidazolium$^+X^-$, 2-n-butyl-1,3-dimethylimidazolium$^+X^-$, 1-ethyl-2,3-dimethylimidazolium$^+X^-$, 1-n-propyl-2,3-dimethylimidazolium$^+X^-$, 1-n-butyl-2,3-dimethylimidazolium$^+X^-$, 1-methyl-3-ethylimidazolium$^+X^-$, 1-methyl-3-n-propylimidazolium$^+X^-$, 1-methyl-3-isopropylimidazolium$^+X^-$, and 1-methyl-3-n-butylimidazolium$^+X^-$ (i.e., BMIM$^+X^-$). Some exemplary quaternary ammonium-based ionic liquids include methylammonium$^+X^-$, dimethylammonium$^+X^-$, trimethylammonium$^+X^-$, tetramethylammonium$^+X^-$, ethylammonium$^+X^-$, and ethyltrimethylammonium$^+X^-$. Some exemplary piperidinium-based ionic liquids include 1,1-dimethylpiperidinium$^+X^-$, 1-methyl-1-ethylpiperidinium$^+X^-$, 1-methyl-1-propylpiperidinium$^+X^-$, and 1-methyl-1-butylpiperidinium$^+X^-$. Some exemplary pyrrolidinium-based ionic liquids include 1,1-dimethylpyrrolidinium$^+X^-$, 1-methyl-1-ethylpyrrolidinium$^+X^-$, 1-methyl-1-propylpyrrolidinium$^+X^-$, and 1-methyl-1-butylpyrrolidinium$^+X^-$. Some phosphonium-based ionic liquids include tetramethylphosphonium$^+X^-$, tetraethylphosphonium$^+X^-$, tetrapropylphosphonium$^+X^-$, tetrabutylphosphonium$^+X^-$, tetrapentylphosphonium$^+X^-$, tetrahexylphosphonium$^+X^-$, and tetraphenylphosphonium$^+X^-$. Some sulfonium-based ionic liquids include trimethylsulfonium$^+X^-$, dimethylethylsulfonium$^+X^-$, diethylmethylsulfonium$^+X^-$, triethylsulfonium$^+X^-$, dimethylpropylsulfonium$^+X^-$, dipropylmethylsulfonium$^+X^-$, tripropylsulfonium$^+X^-$, dimethylbutylsulfonium$^+X^-$, and dibutylmethylsulfonium$^+X^-$.

The ionic liquid may also be a cyclic guanidinium-based ionic liquid. The cyclic guanidinium-based ionic liquid can have any of the structures known in the art, including those described in U.S. Pat. No. 8,129,543 and M. G. Bogdanov, et al., *Z. Naturforsch,* 65b, pp. 37-48, 2010, the contents of which are herein incorporated by reference in their entirety.

In one embodiment, the counteranion $(X^-)$ of the ionic liquid is non-carbon-containing (i.e., inorganic). The inorganic counteranion may, in one embodiment, lack fluorine atoms. Some examples of such counteranions include chloride, bromide, iodide, hexachlorophosphate $(PCl_6^-)$, perchlorate, chlorate, chlorite, cyanate, isocyanate, thiocyanate, isothiocyanate, perbromate, bromate, bromite, periodiate, iodate, dicyanamide (i.e., $N(CN)_2$), tricyanamide (i.e., $N(CN)_3^-$), aluminum chlorides (e.g., $Al_2Cl_7^-$ and $AlCl_4^-$), aluminum bromides (e.g., $AlBr_4^-$), nitrate, nitrite, sulfate, sulfite, hydrogensulfate, hydrogensulfate, phosphate, hydrogenphosphate $(HPO_4^{2})$, dihydrogenphosphate $(H_2PO_4^-)$, phosphite, arsenate, antimonate, selenate, tellurate, tungstate, molybdate, chromate, silicate, the borates (e.g., borate, diborate, triborate, tetraborate), anionic borane and carborane clusters (e.g., $B_{10}H_{10}^{2-}$ and $B_{12}H_{12}^{2-}$), perrhenate, permanganate, ruthenate, perruthenate, and the polyoxometallates. The inorganic counteranion may, in another embodiment, include fluorine atoms. Some examples of such counteranions include fluoride, bifluoride $(HF_2^-)$, hexafluorophosphate $(PF_6^-)$, fluorophosphate $(PO_3F^{2-})$, tetrafluoroborate $(BF_{4-})$, aluminum fluorides (e.g., $AlF_4^-$), hexafluoroarsenate $(AsF_6^-)$, and hexafluoroantimonate $(SbF_6^-)$.

In another embodiment, the counteranion $(X^-)$ of the ionic liquid is carbon-containing (i.e., organic). The organic counteranion may, in one embodiment, lack fluorine atoms. Some examples of such counteranions include carbonate, bicarbonate, the carboxylates (e.g., formate, acetate, propionate, butyrate, valerate, lactate, pyruvate, oxalate, malonate, glutarate, adipate, decanoate, salicylate, ibuprofenate, and the like), the sulfonates (e.g., $CH_3SO_3^-$, $CH_3CH_2SO_3^-$, $CH_3(CH_2)_2SO_3^-$, benzenesulfonate, toluenesulfonate, dodecylbenzenesulfonate, docusate, and the like), the alkoxides (e.g., methoxide, ethoxide, isopropoxide, phenoxide, and glycolate), the amides (e.g., dimethylamide and diisopropylamide), diketonates (e.g., acetylacetonate), the organoborates (e.g., $BR_1R_2R_3R_4^-$, wherein $R_1$, $R_2$, $R_3$, $R_4$ are typically hydrocarbon groups containing 1 to 6 carbon atoms), the alkylsulfates (e.g., diethylsulfate), alkylphosphates (e.g., ethylphosphate or diethylphosphate), and the phosphinates (e.g., bis-(2,4,4-trimethylpentyl)phosphinate). The organic counteranion may, in another embodiment, include fluorine atoms. Some examples of such counteranions include the fluorosulfonates (e.g., $CF_3SO_3^-$, $CF_3CF_2SO_3^-$, $CF_3(CF_2)_2SO_3^-$, $CHF_2CF_2SO_3^-$, and the like), the fluoroalkoxides (e.g., $CF_3O^-$, $CF_3CH_2O^-$, $CF_3CF_2O^-$, and pentafluorophenolate), the fluorocarboxylates (e.g., trifluoroacetate and pentafluoropropionate), and the fluorosulfonylimides (e.g., $(CF_3SO_2)_2N^-$, i.e., $Tf_2N^-$ or TFSI).

The solute of the stabilization solution should dissolve into the solvent and be able to engage in an elimination-addition equilibrium with thermally labile groups on the polyvinyl precursor. The solute is typically either a dissolved gas of a strong mineral acid, or a salt compound, particularly a salt of a strong mineral acid. Typically, in order for the solute to engage in an elimination-addition equilibrium with thermally labile groups on the polyvinyl precursor, the solute contains chemical species equivalent or similar to the thermally labile groups. However, in some embodiments, the solute does not contain chemical species equivalent or even similar to the thermally labile groups, and thus, has the effect of replacing (i.e., substituting) thermally labile groups of the fiber with chemical species of the solute. The substituted groups should engage in an elimination-addition equilibrium with itself and/or original thermally labile groups on the fiber. Some examples of strong mineral acids, as well known in the art, include the halogenic acids (e.g., hydrofluoric, hydrochloric, hydrobromic, and hydroiodic acid), sulfuric acid (which may or may not be fuming, i.e., with or without sulfur trioxide), and nitric acid. Some examples of salt compounds include salts of any of the above strong mineral acids (e.g., sodium sulfate, potassium sulfate, ammonium sulfate, sodium chloride, potassium chloride, ammonium chloride, sodium nitrate, and potassium nitrate) and other salt compounds, not of strong mineral acids, e.g., sodium sulfite, potassium sulfite, ammonium sulfite, sodium nitrite, potassium nitrite, and ammonium nitrite, as well as mixtures thereof. In some embodiments, a strong mineral acid may be included in combination with a salt, particularly a salt of the strong mineral acid. In other embodiments, one or more of the above general classes or specific types of solutes is excluded from the stabilization solution.

In some embodiments, for producing strong carbon fibers, and to avoid contamination with metallic ions, salts of ammonia can be used. For example, a high concentration of aqueous ammonium sulfate could serve as concentrated or dilute sulfuric acid for the pre-carbonization step. A high salt concentration also advantageously elevates the boiling point of the solution, thus making it further suitable for use in a pre-carbonization step.

Although presence of free radicals may be preferable when incorporating leaving groups onto saturated hydrocarbons, a substantial absence of such free radicals is generally preferred for the pre-carbonization step. Since free radicals may cause scission of the polymer backbone, and thermal (pyrolytic) scission of the polymer does not result in a long-range order of unsaturated moieties, an environment substantially or completely devoid of free radicals is generally desirable for the pre-carbonization step.

In some embodiments, one or more free-radical scavengers may be included in the stabilization solution. At least one possible advantage in including a free-radical scavenger is its diminishment or prevention of oxidation via chain scission of the fiber macromolecules by free radicals. Chain scission of the fiber macromolecules by free radicals is believed to result in a loss of orientation and relaxation of grains in the fiber, which is believed, in turn, to result in a reduced strength and modulus of the fiber; thus, inhibition of oxidation via chain scission can be used to make a stronger, higher modulus carbon fiber. The free-radical scavenger can be any compound known in the art that has the ability to scavenge free radicals. Most of the free-radical scavengers are also known to have antioxidant or reducing properties. Some examples of free-radical scavengers include the hindered phenols and ether versions thereof (e.g., butylated phenol, butylated hydroxytoluene, i.e., BHT, polyphenols, and butylated hydroxyanisole), aromatic amines (e.g., trimethyl dihydroquinolines, phenylene diamine, and alkylated diphenyl amines), ascorbic acid, thiols, sulfides, disulfides, thioesters, and phosphites. In other embodiments, one or more of the above general classes or specific types of free-radical scavengers is excluded from the stabilization solution.

The concentration of the solute in the solvent can be any suitable concentration that permits a sufficient elimination-addition process up to the solubility limit of the solute under a given set of conditions (e.g., solvent type, temperature, and nature of the solute). In the case of a solubilized gaseous mineral acid, the weight percent (wt %) is generally no more than 40%, e.g., up to or less than 1, 2, 5, 10, 15, 20, 25, 30, or 35 wt %, or within a range therebetween (or a molarity of up to or less than, for example, 0.5, 1, 2, 3, 4, 5, 6, 7, 8, 9, 10, 11, 12, 13, 14, 15, 16, 17, or 18 M, depending on the solubility limit of the gaseous solute). In some cases, a concentrated solution of the mineral acid is used, wherein a "concentrated solution" has the maximum permissible or commercially feasible concentration of the mineral acid, as well known in the art. In the case of a salt compound, the salt compound may have any of the concentrations provided above, or a concentration of up to, less than, at least, or above, for example, 0.5, 1, 2, 5, 10, 15, 20, 30, 35, 40, 45, or 50 wt %.

The term "first temperature" is any temperature at which the elimination-addition equilibrium occurs, which may be the lowest temperature at which elimination-addition occurs or may be a temperature above the lowest temperature at which elimination-addition occurs, but in any event is below a temperature at which an appreciable degree (or any) pre-carbonization occurs. Typically, the first temperature is at least 50° C., but in different embodiments, and dependent on such factors as the precursor fiber composition and stabilization solution composition, the first temperature may be precisely, about, at least, above, up to, or less than, for example, 55° C., 60° C., 65° C., 70° C., 75° C., 80° C., 85° C., 90° C., 95° C., 100° C., 105° C., 110° C., 115° C., 120° C., 125° C., 130° C., 135° C., 140° C., 145° C., or 150° C., or the first temperature may be a temperature within a range bounded by any two of the foregoing values. The term "final temperature" is the highest temperature that the stabilization solution is raised while the precursor fiber is immersed therein. At or below the final temperature, but above the first temperature, the functionalized precursor fiber becomes at least partially pre-carbonized. Typically, the final temperature is at least 100° C., but dependent on similar factors, may be precisely, about, at least, above, up to, or less than, for example, 105° C., 110° C., 115° C., 120° C., 125° C., 130° C., 135° C., 140° C., 145° C., 150° C., 155° C., 160° C., 165° C., 170° C., 175° C., 180° C., 185° C., 190° C., 195° C., 200° C., 205° C., 210° C., 220° C., 230° C., 240° C., 250° C., 260° C., 270° C., 280° C., 290° C., 300° C., 310° C., 320° C., 330° C., 340° C., 350° C., 360° C., 370° C., 380° C., 390° C., 400° C., 410° C., 420° C., 430° C., 440° C., or 450° C., or up to or below the boiling or decomposition point of the stabilization solution; or the final temperature may be a temperature within a range bounded by any two of the foregoing values. The difference between the first temperature and final temperature is generally at least 20° C., 25 ° C., 30° C., 35° C., 40° C., 45° C., 50° C., 60° C., 70° C., 80° C., 90° C., 100° C., 110° C., 120° C., 130° C., 140° C., 150° C., 160° C., 170° C., 180° C., 190° C., 200° C., 220° C., 250° C., 280° C., or 300° C., or the difference in temperatures is within a range bounded by any two of the foregoing values.

The first temperature is to be distinguished from the initial temperature. The term "initial temperature" refers to a temperature at which the functionalized precursor fiber may be subjected (by the stabilization solution) prior to being subjected to the first temperature. The initial temperature may be the same or lower, but not higher, than the first temperature. In some embodiments, the functionalized precursor fiber is subjected to an initial temperature that is lower than the first temperature, wherein the initial temperature is not sufficient to induce an elimination-addition process with thermally labile groups on the fiber. In such embodiments, the initial temperature may be below or up to any of the exemplary first temperatures provided above, or a temperature of about, at least, above, up to, or less than, for example, 0° C., 5 ° C., 10° C., 15° C., 20° C., 25° C., 30° C., 35° C., or 40° C. In other embodiments, the functionalized precursor fiber is subjected to an initial temperature that is lower than the first temperature, wherein the initial temperature is sufficient to induce an elimination-addition process with thermally labile groups on the fiber. In such embodiments, the initial temperature can be selected from any of the exemplary first temperatures provided above, or a temperature below or up to any of the exemplary first temperatures provided above. In yet other embodiments, the first and initial temperatures may be equivalent, i.e., the first temperature is the temperature of the stabilization bath at the moment the functionalized precursor fiber is originally immersed therein.

The final temperature refers to the highest temperature that the functionalized precursor fiber is subjected while immersed in the stabilization bath. In some embodiments, the resulting pre-carbonized fiber, directly after reaching the final temperature, or directly after an optional dwell time at the final temperature, is removed from the stabilization solution prior to high temperature carbonization. In other embodiments, the resulting pre-carbonized fiber, after reaching the final temperature, is kept immersed in the stabilization bath and subjected to a successive lower temperature therein, which may be, for example, any of the temperatures provided above lower than the final temperature.

The first temperature is raised to the final temperature in a gradual manner, i.e., typically no more than an average temperature ramp rate of 50° C. per minute (i.e., the stabilization solution in which the functionalized precursor fiber is immersed is not increased more than 50° C. within one minute between the first and final temperatures). In different embodiments, the average temperature ramp rate is precisely, about, up to, less than, at least, or above, for example, 50° C., 40° C., 35° C., 30° C., 25° C., 20° C., 18° C., 15° C., 12° C., 10° C., 8° C., 5° C., 4° C., 3° C., 2° C., 1° C., 0.5° C., 0.2° C., or 0.1° C. per minute, or an average temperature ramp rate within a range bounded by any two of the foregoing values.

In one embodiment, the temperature is raised in a stepwise manner from the first to the final temperature. The first temperature can be increased in a stepwise manner by, for example, immersing the fiber into a first stabilization solution bath held at a first temperature for a first dwell time, and removing and re-immersing the fiber into a second stabilization bath held at a final or intermediate temperature for a second dwell time, wherein, within the time period spanning the starting point of the first dwell time and the starting point of the second dwell time, the temperature should not increase by more than 50° C. within one minute. Any number of intermediate baths maintained at successively higher temperatures may be used, e.g., one, two, three, four, five, or six intermediate baths, wherein the intermediate baths can differ in temperature by any suitable amount, e.g., 1, 2, 3, 4, 5, 6, 7, 8, 9, 10, 12, 15, 20, 25, 30, 35, 40, 45, or 50° C. For example, in one embodiment, the fiber is immersed in a first stabilization bath at a temperature of 70° C. for a first dwell time of 10 minutes, and then transferred into a second stabilization (intermediate or final) bath at a temperature of 120° C. for a second dwell time of 10 minutes, which corresponds to a time lapse of about 10 minutes for a temperature change of 50° C., which corresponds to an average temperature ramp rate of 5° C./min. In another embodiment, the fiber is immersed in a first stabilization bath at a temperature of 80° C. for a first dwell time of 1 minute, and then transferred into a second (intermediate) stabilization bath at a temperature of 90° C. for a second dwell time of 1 minute, which corresponds to a time lapse of about 1 minute for a temperature change of 10° C., which corresponds to an average temperature ramp rate of 10° C./min.

In another embodiment, the temperature is raised in a continuous manner from the first to the final temperature. The first temperature can be increased in a continuous manner by, for example, gradually raising the temperature of the stabilization solution in which the fiber is immersed, wherein the fiber is kept immersed in the stabilization solution during at least the period of time between the first temperature to the final temperature, and may also be kept immersed from an earlier initial temperature to the final temperature, or from the initial or first temperature to a successive lower temperature after the final temperature. Alternatively, the temperature is raised in a continuous manner by passing the fiber through a stabilization solution having a temperature gradient. For example, the stabilization solution may be contained within a cylindrical vessel wherein a vertical temperature gradient is established, and the fiber passed over a suitable time period from a lower temperature region to a higher temperature region of the stabilization solution. In some embodiments, the gradual increase in temperature may include both stepwise and continuous aspects, e.g., passing the fiber through successive baths that have a temperature gradient. During a continuous increase in temperature, the average temperature ramp rate is equivalent to the actual temperature ramp rate at any time point within the continuous temperature gradient.

The time period between the first temperature and final temperature is any suitable period of time that maintains the gradual increase in temperature set forth above, and that results in a pre-carbonized fiber. In different embodiments, the time period between first and final temperatures is about, at least, above, up to, or less than, for example, 10, 15, 20, 25, 30, 40, 50, 60, 70, 80, 90, 100, 120, 150, 180, 210, or 240 minutes.

Whether the gradual increase in temperature is provided in a stepwise or continuous manner, the fiber may be processed in a batch process or continuous process. In a batch process, a batch amount of fiber (e.g., a discrete amount of fiber, fiber segments, fiber mesh, or particles made from fiber) is processed either in a stepwise or continuous mode of increasing temperature. In a continuous process, a continuous stream of fiber (e.g., as dispensed from a creel or spool) is processed either in a stepwise or continuous mode of increasing temperature.

In particular embodiments, a precursor fiber (functionalized or non-functionalized) is treated in a two-part stabilization process in which the fiber is first treated in oleum and then treated in concentrated sulfuric acid. Oleum (fuming sulfuric acid) is a highly aggressive sulfonating medium with a lower boiling point than concentrated sulfuric acid, and conversely, concentrated sulfuric acid is a much less aggressive sulfonating medium with a higher boiling point than oleum. Thus, the precursor fiber can be first rapidly sulfonated with oleum at a mild temperature (e.g., at least, above, up to, or less than 30, 40, 50, 60, 70, or 80° C. for a period of time of, for example, 20, 30, 40, 45, 50, 60, 70, 80, or 90 minutes) to achieve a substantially sulfonated precursor fiber, and the sulfonated precursor fiber treated in concentrated sulfuric acid at increasing temperature where elimination-addition equilibrium and then pre-carbonization occurs. In other embodiments, a non-functionalized precursor fiber is treated in concentrated sulfuric acid to sulfonate and then pre-carbonize the fiber (i.e., from the start of sulfonation to the final temperature at which pre-carbonization is achieved) either in one, two, or multiple sulfuric acid baths.

In other embodiments, the initial functionalization is done in concentrated sulfuric acid baths at moderate temperature (120° C.) and then immersed in an aggressive sulfonating bath of oleum at a similar temperature to complete the functionalization. The functionalization is then followed by an elimination-addition equilibrium process (e.g., in oleum or sulfuric acid) conducted up to or at a final temperature to obtain a pre-carbonized fiber.

In some embodiments, the stabilization process described above is conducted under an oxygen-containing environment, such as ambient air or an oxygen-inert gas mixture. In other embodiments, the stabilization process described above is conducted under an inert atmosphere. Some examples of inert atmospheres include nitrogen ($N_2$) and the noble gases (e.g., helium or argon). Aside from conducting the stabilization process under an inert atmosphere, the stabilization solution may also be purged with inert gas in an effort to substantially diminish the level of oxygen gas and oxidizing radicals present in the stabilization solution. In some embodiments, oxygen gas in the stabilization solution may be substantially or completely removed (e.g., up to or less than 100, 50, 10, 5, 1, 0.5, or 0.1 ppm).

Generally, the pre-carbonized fiber, after completing the stabilization process, is washed to remove residual concentrated acid or salt species on the surface of the fiber before the fiber undergoes high temperature carbonization. In a situation where washing with water would not result in a high heat of dilution, the pre-carbonized fiber may be washed with water, which may be pure (e.g., deionized) water or water containing trace amounts of a solute. However, in some situations, particularly when the fiber has been treated with concentrated sulfuric acid or oleum, subsequent direct washing of the treated fiber with water would result in a high enough heat of dilution to cause damage to the fiber. In an effort to overcome this problem, a multi-part washing process has herein been developed wherein the pre-carbonized fiber, after exiting the stabilization bath, is transferred into a bath containing the acid or salt used in the stabilization process, but at a lower concentration. Any number of baths may be used in which the concentration of acid or salt is progressively decreased. Typically, the final washing step before carbonization is with water. For example, a pre-carbonized fiber that had been treated in concentrated sulfuric acid or oleum may be successively washed in 12 molar, 8 molar, 4 molar, 2 molar, and 1 molar sulfuric acid solutions, followed by a water washing step. The washed carbon fiber may be dried (e.g., by blow drying and/or solvent washing) before the high temperature carbonization step.

In the method, after formation of the pre-carbonized fiber, the pre-carbonized fiber is then subjected to high temperature carbonization conditions to form the high strength and/or high modulus carbon fiber. The carbonization step includes any of the conditions, as known in the art, that result in carbonization of an organic precursor. Generally, in different embodiments, the carbonization temperature is precisely, about, or at least 400° C., 450° C., 500° C., 550° C., 600° C., 650° C., 700° C., 750° C., 800° C., 850° C., 900° C., 950° C., 1000° C., 1050° C., 1100° C., 1150° C., 1200° C., 1250° C., 1300° C., 1350° C., 1400° C., 1450° C., 1500° C., 1600° C., 1700° C., 1800° C., 1900° C., 2000° C., 2100° C., 2200° C., 2300° C., 2400° C., 2500° C., 2600° C., 2700° C., 2800° C., 2900° C., 3000° C., 3100° C., or 3200° C., or a temperature within a range bounded by any two of the foregoing temperatures. The amount of time that the pre-carbonized fiber is subjected to the carbonization temperature (i.e., carbonization time) is highly dependent on the carbonization temperature employed. Generally, the higher the carbonization temperature employed, the shorter the amount of time required. In different embodiments, depending on the carbonization temperature and other factors (e.g., pressure), the carbonization time can be, for example, about, at least, or no more than 0.02, 0.05, 0.1, 0.125, 0.25, 0.5, 1, 2, 3, 4, 5, 6, 7, 8, 9, 10, 11, or 12 hours, or within a range therein. In particular embodiments, it may be preferred to gradually raise the temperature at a set or varied temperature ramp rate (e.g., 5° C./min, 10° C./min, or 20° C./min). In particular embodiments, it may be preferred to pass the pre-carbonized fiber through a furnace with a gradient of temperature at the entrance and exit of the furnace and at a set temperature inside the furnace in order to achieve the desired residence time. In other embodiments, it may be preferred to subject the pre-carbonized fiber to a sudden (i.e., non-gradual) carbonization temperature. In some embodiments, after the pre-carbonized fiber is subjected to a desired carbonization temperature for a particular amount of time, the temperature is reduced either gradually or suddenly.

In particular embodiments, the carbonization process includes a low (first) temperature carbonization step and a high (second) temperature carbonization step, which may be run at different temperatures independently selected from any of the exemplary temperatures provided above. The low temperature step is generally employed as a pyrolysis step, i.e., to remove volatiles. The low temperature step is typically conducted at a temperature of at least or above 400, 500, or 600° C., and up to or less than 800, 900, 1000, 1100, or 1200° C. The high temperature step is generally employed to substantially or completely carbonize the pre-carbonized fiber. The high temperature step is typically conducted at a temperature of at least or above 1200, 1300, 1400, 1500, 1600, 1700, 1800, 1900, 2000, or 2100° C., or at a temperature within a range bounded by any two of the foregoing temperatures, or at a temperature within a range bounded by any of the foregoing temperatures and up to or less than 2200° C. The processing times for the low and high temperature steps can each be, independently, any of the amount of times provided above. Alternatively, the combined time for the low and high temperature steps may correspond to any of the processing times provided above. If desired, one or more additional carbonization steps may be included with temperatures intermediate to the first and second carbonization steps. In some embodiments, the different steps are characterized by a distinct (i.e., non-gradual) change in temperature, such as from 600° C. in a low temperature step to 1200° C. or higher in a high temperature step. The pre-carbonized fiber can be maintained in the same reaction tube when subjected to successive carbonization steps. In preferred embodiments, the demarcation between carbonization steps is not so distinct, such as by gradually increasing the carbonization temperature to transition from one step into the next through furnaces maintained at different temperatures or temperature ranges.

If desired, the pre-carbonized fiber can be subjected to a carbonization temperature high enough to produce a graphitized non-woven mat or paper. Typically, the temperature capable of causing graphitization is a temperature of precisely, about, at least, above, or up to, for example, 2200° C., 2300° C., 2400° C., 2500° C., 2600° C., 2700° C., 2800° C., 2900° C., 3000° C., 3100° C., or 3200° C., or a temperature within a range bounded by any two of these temperatures. Generally, a graphitization process is conducted after a carbonization process. In a preferred embodiment, the pre-carbonized fiber is sequentially passed through various processing zones, for example, low temperature carbonization is conducted in a furnace maintained at temperatures ranging from 400-1200° C., high temperature carbonization is conducted in a furnace maintained at temperatures ranging from 1200-2200° C., and graphitization is conducted in a furnace maintained at temperatures ranging from 2200-3200° C.

Typically, the carbonization and/or graphitization step is conducted in an atmosphere substantially devoid of a reactive gas (e.g., oxygen or hydrogen), and typically under an inert atmosphere. Some examples of inert atmospheres include nitrogen ($N_2$) and the noble gases (e.g., helium or argon). The inert gas is generally made to flow at a specified flow rate, such as 0.1, 0.25, 0.50, 1, 5, 10, 20, or 30 L/min. However, for high volume industrial manufacturing, the inert gas flow rate can be much higher, such as 50 L/min, 100 L/min, 500 L/min, 1000 L/min, or even several thousands of L/min. Moreover, one or more reactive functionalizing species may be included in the carbonization step or in a post-treatment step (e.g., at the exit of the furnace as a post-carbonization step) to suitably functionalize the carbon fiber, e.g., by inclusion of a fluorocarbon compound to induce fluorination, or inclusion of an oxygen-containing species to induce oxygenation (to include, e.g., hydroxy or ether groups), or inclusion of a silico-, amino-, thio-, or phosphino-species to silylate, aminate, thiolate, or phosphinate the carbon fiber. Thus, in some embodiments, it may be preferred to include at least one reactive gas, such as oxygen, hydrogen, a silane, ammonia, an organoamine, carbon dioxide, methane, a fluoroalkane, a phosphine, or a mercaptan during or after the carbonization and/or graphitization process. The one or more reactive gases may, for example, desirably change or adjust the compositional, structural, or physical characteristics of the carbon fiber. The functionalized groups on the carbon fiber can have a variety of functions, e.g., to bind to metal species that are catalytically active, or to modify or adjust the surface miscibility, absorptive, or wetability characteristics, particularly for gas absorption and filtration applications, or to improve bonding or adhesion with a host matrix material.

The pressure employed in the carbonization (or graphitization) step is typically ambient (e.g., around 1 atm). However, in some embodiments it may preferred to use a higher pressure (e.g., above 1 atm, such as 1.5, 2, 5, 10, 20, or 50 atm, or within a range therein) to, for example, maintain a positive pressure inside the furnace and keep the sample free of oxygen at high temperature to avoid combustion or partial combustion. In other embodiments, it may be preferred to use a lower pressure (e.g., below 1 atm, such as 0.5, 0.1, 0.05, or 0.01 atm, or within a range therein).

The method described herein may furthermore include a process for producing the functionalized precursor fiber. The functionalized precursor fiber can be produced by any of the means known in the art, including by the addition polymerization of vinyl monomers containing thermally labile functional groups (e.g., vinyl chloride, vinylidene chloride, vinyl sulfate, vinyl amine, vinyl acetate, or vinyl alcohol), or by post-functionalization of a polyolefin, or by reaction of a pre-functionalized precursor fiber to modify the functional groups thereon.

In particular embodiments, the functionalized precursor fiber is sulfonated polyolefin fiber. Sulfonated polyolefin fibers can be produced by any of the methods and conditions known in the art for sulfonating polyolefin fibers. As used herein, the term "sulfonated" is meant to be inclusive of sulfonation and any other type of sulfuration that may occur on the surface of polyolefin fibers during a sulfonation process. Some other types of sulfuration that may occur on the surface of the polyolefin fibers during a sulfonation process may be, for example, sulfation, chloro-sulfonation, sulfoxidation, as well as the production of sulfonic acid groups and esters thereof. In some embodiments, any one or more of the foregoing exemplary sulfur-containing groups may be absent, or in a predominant or minor amount relative to other sulfur-containing groups. The sulfonation methods and conditions considered herein can be any of the processes known in the art in which a polymer fiber is exposed to a source of $SO_x$ species (typically, $SO_2$, often in an oxidizing environment, such as $O_3$, and/or $SO_3$ in an inert environment) for the purpose of sulfonating the polymer fiber. The sulfonation methods and conditions considered herein can be, for example, any of the processes known in the art in which a polymer fiber is submerged in a sulfonation bath of, for example, sulfuric acid, fuming sulfuric acid, or chlorosulfonic acid, or their mixtures, in order to sulfonate the polymer fiber. As further discussed below, the conditions of the sulfonation step can be selected to either completely sulfonate or partially sulfonate the polyolefin fiber. For example, adjustments in residence time, processing temperature, and reactivity or concentration of the sulfonating species will also adjust the degree of sulfonation. Therefore, one or more of these variables can be suitably modified to achieve a complete, partial, or specific degree of sulfonation.

As used herein, the terms "partially sulfonated," "partial sulfonation," "incompletely sulfonated," or "incomplete sulfonation" all have equivalent meanings and are defined as an amount of sulfonation below a saturated (or "complete") level of saturation. The degree of sulfonation can be determined by, for example, measuring the thermal characteristics (e.g., softening or charring point, or decomposition temperature associated with pyrolysis of incompletely sulfonated polyolefin) or physical characteristics (e.g., density, rigidity, or weight fraction of decomposable unsulfonated-polymer segment) of the partially sulfonated fiber. Since rigidity, as well as the softening and charring point (and thermal infusibility, in general) all increase with an increase in sulfonation, monitoring of any one or combination of these characteristics can be correlated with a level of sulfonation relative to a saturated level of sulfonation. In particular, a fiber can be considered to possess a saturated level of sulfonation by exhibiting a constant thermal or physical characteristic with increasing sulfonation treatment time. In contrast, a fiber that has not reached a saturated level of sulfonation will exhibit a change in a thermal or physical characteristic with increasing sulfonation treatment time. Moreover, if the fiber with a saturated degree of sulfonation is taken as 100% sulfonated, fibers with a lesser degree of sulfonation can be ascribed a numerical level of sulfonation below 100%, which is commensurate or proportionate with the difference in thermal or physical characteristic between the partially sulfonated fiber and completely sulfonated fiber. In different embodiments, the fiber precursor is sulfonated up to or less than a sulfonation degree of 95%, 90%, 85%, 80%, 75%, 70%, 65%, 60%, 55%, 50%, 45%, 40%, 35%, 30%, 25%, 20%, 15%, 10%, or 5% relative to a saturated level of sulfonation taken as 100%. The level of sulfonation can be further verified or made more accurate by an elemental analysis.

In one embodiment, to sulfonate the polyolefin fiber, the polyolefin fiber is submerged into or passed through sulfuric acid, or a liquid (typically, an aqueous solution) containing sulfur trioxide ($SO_3$), a sulfur trioxide precursor (e.g., chlorosulfonic acid, $HSO_3Cl$), sulfur dioxide ($SO_2$), or a mixture thereof. In some embodiments, the polyolefin fiber is passed through the liquid by pulling the fiber into the liquid from a creel of fiber spool either unconstrained or held at a specified tension. The liquid containing sulfur trioxide is typically fuming sulfuric acid (i.e., oleum, which typically contains 5-30% (or more particularly, 15-30%) free $SO_3$) or chlorosulfonic acid, or a liquid solution thereof.

In other embodiments, to sulfonate the polyolefin fiber, the polyolefin fiber is contacted with a sulfonating gas in a gaseous atmosphere (i.e., not in a liquid). For example, the polyolefin fiber can be introduced into a chamber containing $SO_2$ or $SO_3$ gas, or a mixture thereof, or a gaseous reactive precursor thereof, or mixture of the $SO_2$ and/or $SO_3$ gas with another gas, such as oxygen, ozone, or an inert gas, such as nitrogen or a noble gas (e.g., helium or argon).

In some embodiments the polvinyl (or polyolefin) precursor fiber is activated prior to sulfonation. The pre-sulfonating liquid or gas may include (i.e., be admixed with) one or more oxidants that may favorably adjust the density or type of oxidized groups formed on the polyolefin fiber surface. Some examples of oxidants include ozone, air, oxygen, an inorganic or organic peroxide (e.g., hydrogen peroxide, cumene peroxide, or benzoyl peroxide), a peroxy acid (e.g., a peroxysulfuric or peroxycarboxylic acid), a chromate or dichromate (e.g., $K_2Cr_2O_7$), permanganate (e.g., $KMnO_4$), hypochlorite (e.g., HOCl or NaOCl), chlorite, perchlorate (e.g., $NaClO_4$), or nitrate (e.g., $HNO_3$ or $KNO_3$).

In other embodiments, to sulfonate the polyolefin fiber, a polyolefin precursor resin is melt-mixed with a sulfonation additive (i.e., sulfonated solid-state material that evolves a $SO_x$ gas at elevated temperatures), and the resulting melt-mixed composite spun to produce a melt-mixed composite fiber. Thus, the melt-mixed composite fiber contains polyolefin precursor resin as an unsulfonated matrix material within which the sulfonation additive is incorporated. The resulting melt-mixed composite fiber (i.e., "melt-spun fiber") is then heated to a desulfonation temperature effective for the liberation of $SO_x$ gas from the sulfonation additive. Liberation of $SO_x$ gas from the sulfonation additive results in complete or partial sulfonation of the polyolefin matrix under an inert or oxic environment. A particular advantage of this melt-mixing methodology is that the amount of sulfonation of the fiber material can be carefully controlled by precisely quantifying the amount of sulfonation material (e.g., by weight or molar ratio of the sulfonation material with respect to total amount of composite material). In some embodiments, a completely sulfonated fiber exhibits 1 mole of sulfonate or sulfate per mole of polyethylene repeat unit. In some embodiments, a completely sulfonated fiber gains 0.5 moles of sulfonate or sulfate per mole of polyethylene repeat unit, through a diffusion-controlled process.

The sulfonation additive can be any solid-state compound or material bearing reactive $SO_x$-containing groups (typically, —$SO_3H$, or sultone, i.e., —($SO_2$—O)—, or sulfate —(O—$SO_2$—O)— groups) that function to liberate $SO_2$ and/or $SO_3$ under elevated temperatures. In particular embodiments, the sulfonation additive is an organic (i.e., carbon-containing or carbonaceous) sulfonated compound or material. Some examples of organic sulfonated compounds or materials that function as sulfonation additives include sulfonated graphene, sulfonated diene rubber, sulfonated polyolefin, polyvinyl sulfate, sulfonated polystyrene, sulfonated lignin, and sulfonated mesophase pitch. Such organic sulfonated compounds are either commercially available or can be produced by methods well known in the art (e.g., by any of the liquid or gas sulfonation processes known in the art, as discussed above). Inorganic non-metallic sulfates, such as ammonium sulfate, ammonium bisulfate, or other such sulfates, can also be used as a sulfonation additive in the precursor matrix. Moreover, to increase compatibility of the additive with the polyolefin polymer, the sulfonation additive (e.g., graphene or other polycyclic aromatic compound or material) may be functionalized with hydrophobic aliphatic chains of sufficient length (e.g., hexyl, heptyl, octyl, or a higher alkyl chain) by methods well known in the art.

In a particular embodiment, the sulfonation additive is elemental sulfur, which can be melt-mixed with polyolefin precursor. The elemental sulfur-mixed polyolefin resin is then spun into fiber or non-woven mat form. Then the precursor, either in mat or filament form, is oxidized, such as in air, ozone, or in oxidizing liquid bath, as described above, to obtain the sulfonated precursor.

In still other embodiments, to produce a sulfonated polyolefin fiber, fibers are produced (e.g., drawn) from a sulfonated polyolefin resin. The sulfonated polyolefin resin can be produced by, for example, sulfonating a polyolefin resin by any of the techniques described above. Fibers can be produced from the sulfonated polyolefin resin by any of the fiber-producing techniques known in the art and as herein described, e.g., by solution spinning, gel-spinning, solvent or plasticizer-assisted melt-spinning, or melt processing.

In another embodiment, completely or partially sulfonated polyolefins are plasticized with a suitable (i.e., plasticizing) solvent, such as dimethyl sulfoxide, dimethyl formamide, an oil (e.g., an inorganic oil, such as silicone oil, or an organic oil, such as vegetable oil) or concentrated or dilute sulfuric acid, at varied dilutions and processed in the form of a gel at low temperature in a coagulation bath to obtain solution-spun completely- or partially-sulfonated fibers. In particular embodiments, sulfonated additives, such as organic sulfonated compounds, are incorporated into the fiber by doping them into the plasticized polymer gel. Sulfonated additives serve as a source of $SO_x$ gas at elevated temperatures and serve as sulfonating agents in an oxic environment.

The period of time (i.e., residence time) that the polyolefin fiber is exposed to the sulfonating species at the sulfonating temperature, as well as the temperature during exposure to the sulfonating species (i.e., sulfonation temperature) can be suitably adjusted to provide a complete sulfonation or a level of sulfonation below a complete sulfonation (i.e., partial sulfonation). In some embodiments, the degree of sulfonation (DS) can be determined or monitored at points during the process by use of thermogravimetric analysis (TGA), dynamic mechanical analysis (DMA), density measuring device, or other suitable analytical technique.

The sulfonation temperature is generally below a carbonization temperature, and more typically, at least 0° C., 10° C., 20° C., 30° C., 40° C., or 50° C., and up to 300° C. In different embodiments, the sulfonation temperature is precisely or about 30° C., 40° C., 50° C., 60° C., 70° C., 80° C., 90° C., 100° C., 110° C., 120° C., 130° C., 140° C., 150° C., 160° C., 170° C., 180° C., 190° C., 200° C., 210° C., 220° C., 230° C., 240° C., 250° C., 260° C., 270° C., 280° C., 290° C., or 300° C., or a sulfonation temperature within a range bounded by any two of the foregoing values (for example, at least or above 30° C., 40° C., 50° C. and up to or less than 200° C., 250° C., or 300° C.; or at least or above 50° C. and up to or less than 160° C., 170° C., or 180° C.; or at least or above 70° C. and up to or less than 120° C., 140° C., 160° C., or 180° C.).

The residence time at sulfonation is very much dependent on several variables, including the sulfonation temperature used, concentration of sulfonating agent in the reaction medium, level of applied tension (if any), crystallinity of the precursor polymer, and the thickness of the polyolefin fiber. The residence time is also dependent on the sulfonation method used (i.e., liquid or gas phase processes). As would be appreciated by one skilled in the art, the degree of sulfonation achieved at a particular sulfonating temperature and residence time can be replicated by use of a higher sulfonation temperature at a shorter residence time, or by use of a lower sulfonation temperature at a longer residence time. Similarly, the residence time required to achieve a degree of sulfonation in a polyolefin fiber of a certain thickness may result in a higher degree of sulfonation in a thinner fiber and a lower degree of sulfonation in a thicker fiber with all other conditions and variables normalized. Generally, for polyolefin fibers having a thickness in the range of 0.5 to 50 microns, a residence time at sulfonation of up to about 90 minutes provides a partial sulfonation (i.e., where sulfonation has not occurred through the entire diameter of the fiber through the core, thus producing a surface-sulfonated polyolefin fiber), whereas a residence time above 90 minutes generally provides a complete sulfonation for the indicated thickness. In different embodiments, depending on such variables as the sulfonation temperature and fiber thickness, the residence time at sulfonation may be suitably selected as precisely, about, up to, or less than 180 minutes, 150 minutes, 120 minutes, 90 minutes, 60 minutes, 30 minutes, 20 minutes, 10 minutes, 5 minutes, or 1 minute, or a residence time within a range bounded by any two of the foregoing values. During sulfonation, at the sulfonation reaction temperature, a tensile stress of any suitable degree can be employed, such as a tensile stress of 0, 1, 5, 10, or 15 MPa, or within a range thereof. Precursor crystallinity depends on the nature of the polymer and molecular orientation in the fiber form and typically has a value from 0 to 80%.

Generally, for polyolefin fibers having a thickness in the range of 15 to 20 microns, complete sulfonation (i.e., to the core of the fiber) will occur at: a sulfonation temperature of 150° C. or greater when employing a sulfonation residence time of about 5-10 minutes or greater; or a sulfonation temperature of 140° C. or greater when employing a residence time of about 10-15 minutes or greater; or a sulfonation temperature of 130° C. or greater when employing a residence time of about 15-20 minutes or greater; or a sulfonation temperature of 120° C. or greater when employing a residence time of about 20-25 minutes or greater; or a sulfonation temperature of 110° C. or greater when employing a residence time of about 25-30 minutes or greater; or a sulfonation temperature of 100° C. or greater when employing a residence time of about 30-35 minutes or greater; or a sulfonation temperature of 90° C. or greater when employing a residence time of about 35-40 minutes or greater; or a sulfonation temperature of 70° C. or greater when employing a residence time of about 40-45 minutes or greater. Therefore, for any of the foregoing examples, a reduction in sulfonation temperature or residence time should generally have the effect of achieving a partial sulfonation (i.e., a surface sulfonation) for polyolefin fibers having a thickness in the range of 15 to 20 microns.

The above exemplary sulfonation temperatures and residence times are not meant to be taken precisely, but as approximate and typical for polyolefin fibers having a thickness in the range of 15 to 20 microns. For polyolefin fibers having a thickness below the aforesaid range, lower sulfonation temperatures and/or lower residence times may be used to achieve the same effect or if a partial sulfonation is desired; and likewise, for polyolefin fibers having a thickness above the aforesaid range, higher sulfonation temperatures and higher residence times can be used to achieve the same effect, or the same or lower sulfonation temperatures and/or residence times may be used to achieve a partial sulfonation. Moreover, generally, for polyolefin fibers having a thickness in the range of 15 to 20 microns, a residence time at sulfonation of 2 minutes is too short to achieve complete sulfonation (to the core of the fiber) at a sulfonation temperature of 160° C. or less. Further, to accelerate the sulfonation process, the temperature cannot simply be elevated to allow the sulfonation to occur at a faster rate, since at a high enough temperature, a semi-crystalline polyolefin fiber will melt. For example, polyethylene neat fiber cannot be sulfonated at 130° C., since it melts and the fiber line breaks at a temperature above 120° C. However, if the fiber is pre-sulfonated, even if partially, it can then be passed through a higher temperature bath to complete the degree of sulfonation and permit an elimination-addition equilibrium. Similarly, neat polypropylene cannot be sulfonated at 175° C., since it melts at that temperature. In particular embodiments, a partially sulfonated tow of filaments of 1 to 30 micron thicknesses is produced by varying one or more of the above parameters. The foregoing exemplary combinations of sulfonation temperatures and residence times are particularly relevant to liquid phase and gas phase sulfonation processes described above.

In particular embodiments, a partial sulfonation process is employed on the polyolefin fibers. Particularly when a liquid phase or gas phase sulfonation process is used, the partial sulfonation process results in a surface-sulfonated polyolefin fiber (i.e., which possesses an unsulfonated core). The surface-sulfonated polyolefin fiber is achieved by judicious selection of sulfonation temperature and residence time, appropriate for the fiber thickness, that halts sulfonation before the entire diameter of the fiber through the core becomes sulfonated. Generally, this is achieved by limiting the residence time at a particular sulfonation temperature to a time below that which would result in complete sulfonation through the core. Moreover, by adjusting the residence time, the thickness of the unsulfonated core and sulfonated surface can be correspondingly adjusted. For example, increasing the residence time at a particular sulfonation temperature would have the effect of thickening the sulfonated surface and narrowing the unsulfonated core, while decreasing the residence time at a particular sulfonation temperature would have the effect of narrowing the sulfonated surface and thickening the unsulfonated core. Unsulfonated portions will volatilize and sulfonated portions will carbonize during carbonization. Thus, this ability to carefully adjust sulfonated surface and unsulfonated core thicknesses is advantageous in producing hollow carbon fibers (i.e., after a carbonization step) having precise carbon wall thicknesses and hollow core diameters.

If desired, the thickness of the sulfonated surface and unsulfonated core can be further adjusted by including an autocatalytic solid-state desulfonation-sulfonation step (i.e., "desulfonation step" or "desulfonation process") at the interface of the sulfonated sheath and unsulfonated core (i.e., "sheath-core interface"). During the desulfonation-sulfonation process, the aforesaid interface gradually propagates towards the core. In the desulfonation process, the surface-sulfonated polyolefin fiber is heated to a desulfonation temperature effective for the liberation of $SO_x$ gas from the sulfonated surface. As the sulfonated sheath is rigid and becomes crosslinked after desulfonation, in the sulfonation phase, $SO_x$ gas molecules liberated from the surface migrate toward the core, thereby partially sulfonating additional polymeric material toward the core. This results in a narrower unsulfonated core and thicker sulfonated surface, or eventually, partial sulfonation throughout the fiber including through the core. The higher the temperature and the longer the residence time at the desulfonation temperature, the narrower the unsulfonated core and the thicker the crosslinked sheath. In some embodiments, the desulfonation temperature is employed for a period of time less than the time required for the entire polyolefin fiber to be partially sulfonated through the core. The instant application also includes the possibility of employing a desulfonation step for a period of time effective to partially sulfonate the polyolefin fiber through the core. In the foregoing embodiment, no unsulfonated core remains.

When a desulfonation process is employed, the desulfonation temperature can independently be selected from any of the sulfonation temperatures and residence times provided above (e.g., at least 30° C., 40° C., 50° C., 60° C., or 70° C., and up to or less than 120° C., 140° C., 160° C., 180° C., 200° C., 250° C., or 300° C.). Moreover, a desulfonation (inverse sulfonation) process is generally practiced herein in the absence of an external sulfonating source, thereby not further adding sulfonating species to the fiber, but limiting the amount of sulfonating species to the amount present in the sulfonated surface or the amount incorporated into polymer fiber for a melt-mixed fiber. The desulfonation process is generally practiced herein in an oxygen-containing (i.e., $O_2$-containing or oxic) environment, such as air or an artificial oxygen-inert gas atmosphere, which may be conducted at either standard pressure (e.g., 0.9-1.2 bar), elevated pressure (e.g., 2-10 bar), or reduced pressure (e.g., 0.1-0.5 bar). In other embodiments, a pressure of precisely, about, or at least 0.1, 0.2, 0.5, 1, 2, 3, 4, 5, 6, 7, 8, 9, or 10 bar, or a pressure within a range therein, is employed.

In some embodiments, the sulfonation and/or desulfonation process includes exposing the fiber (before, during, and/or after the sulfonation or desulfonation process) to radiative energy. The radiative energy can be, for example, electromagnetic radiation (e.g., ultraviolet, X-ray, infrared, or microwave radiation) or energetic particles (e.g., electron or neutron beam). In the case of electromagnetic radiation, the radiation may be dispersed or collimated, as in a laser. In some embodiments, the radiative energy is ionizing, while in other embodiments it is not ionizing. The fiber may alternatively or additionally be exposed to radiative energy before, during, or after sulfonation and/or carbonization. In some embodiments, electromagnetic or energetic particle radiation is not employed.

Processes analogous to the above sulfonation process can be employed to functionalize a polyolefin fiber with functional groups other than sulfonate groups. For example, a polyolefin fiber may be reacted with concentrated hydrochloric acid, typically with a mechanism for in situ production of chlorine gas (e.g., by electrocatalytic means) to chlorinate the polyolefin fiber.

In some embodiments, the functionalized polyvinyl precursor is produced from non-functionalized polyolefin fiber precursor in a separate process, as described above, prior to immersing the fiber into the stabilization solution. In other embodiments, the functionalized polyvinyl precursor is produced from non-functionalized polyolefin fiber precursor during the time the fiber is immersed in the stabilization solution. In the latter embodiment, the stabilization solution serves a dual purpose to both functionalize the polyvinyl precursor fiber and to establish an elimination-addition equilibrium therewith, and ultimately, to pre-carbonize the functionalized polyvinyl precursor. When the non-functionalized polvinyl precursor fiber is immersed in the stabilization solution, depending on the initial temperature and other factors, the functionalization process may occur before or in conjunction with the elimination-addition process.

The non-functionalized polyolefin (to be functionalized) is typically polyethylene, polypropylene, or a homogeneous or heterogeneous composite thereof, or a copolymer thereof. In the case of polyethylene, the polyethylene can be any of the types of polyethylene known in the art, e.g., low density polyethylene (LDPE), linear low density polyethylene (LLDPE), very low density polyethylene (VLDPE), high density polyethylene (HDPE), medium density polyethylene (MDPE), high molecular weight polyethylene (HMWPE), and ultra high molecular weight polyethylene (UHMWPE). In the case of polypropylene, the polypropylene can also be any of the types of polypropylenes known in the art, e.g., isotactic, atactic, and syndiotactic polypropylene. The polyolefin precursor may or may not also be derived from, or include segments or monomeric units of other addition monomers, such as acrylic acid, methacrylic acid, methyl acrylate, methyl methacrylate, vinyl acetate (as well as partially or fully hydrolyzed derivatives of vinyl acetate, such as vinyl alcohol), and acrylonitrile.

In another aspect, the invention is directed to a method for the preparation of a woven or non-woven mat, paper, or film made of carbon fibers produced according to the special stabilization process described herein. The carbon fibers in the mat or paper are interconnectedly bonded together (i.e., fused) to form a single cohesive unit in which the fibers will generally not unravel or separate from each other under most conditions. Generally, the mat or paper is porous, but the mat or paper may be less porous or completely or substantially non-porous if the fibers are appropriately tightly spaced. As generally understood in the art, if the interconnected randomly oriented (or preferentially oriented) filaments are held together loosely (i.e., with loops or gaps in a non-flattened form) the bonded filaments are generally referred to as a non-woven mat. However, if the bonded filaments are closely packed and substantially flattened as a sheet, the bonded filaments are generally referred to as a paper or film The terminology used here is similar to that used for non-woven mat made from cellulosic filaments, such as cotton or rayon, whereas the pressed thin films of bonded cellulosic fibrils of very small diameters are referred to as paper.

In the method for forming a mat, a preform (i.e., precursor) containing a plurality of bonded or interweaved sulfonated polyolefin fibers is first provided. By one embodiment, the preform is manufactured by bonding polyolefin fibers that have been sulfonated. Any suitable methodology for bonding the sulfonated polyolefin fibers is applicable herein. The bonding can be, for example, a chemically- or physically-induced bonding process. A chemically-induced bonding process relies on one or more chemicals that cause or encourage the sulfonated fibers to bond, and the one or more chemicals or a degradation product thereof may or may not remain in the final carbon mat or paper. For example, desulfonation of polyethylene results in an unsaturated derivative (on the fiber surface and core as well), and the unsaturated derivative can undergo interfilament cross-linking by temperature, peroxide or other initiator, or radiation. A physically-induced bonding process relies on one or more physical processes, such as, for example, pressure, heat (e.g., thermally bonded filament web or non-woven mat), or a radiative source (e.g., electromagnetic or particle bombardment) to induce bonding. There will be significant ionic bonding through sulfonic acid groups of the surface of sulfonated filaments.

In a particular embodiment, the sulfonated polyolefin fibers are bonded by contacting the sulfonated polyolefin fibers with water, which can be relatively or substantially pure water, or alternatively, an aqueous solution. Without being bound by any theory, the strong interfilament bonding is believed to be mediated by the presence of sulfur-containing and possibly other oxidized groups on the surface of the sulfonated polyolefin fibers that likely form extensive hydrogen bonding interactions with each other particularly when they interact with water molecules.

To produce the mat or paper preform, partially or completely sulfonated polyolefin fibers may be arranged in a non-woven mat or paper form, and then bonded, as described above, to form the preform. In other embodiments, unsulfonated polyolefin fibers are arranged in a non-woven mat or paper form, and then bonded, by any of the chemical or physical techniques described above (e.g., hot stamping, partial melting, or plasticization) to form a preform that is then subjected to sulfonation conditions to partially or completely sulfonate the preform. In yet other embodiments, polyolefin fibers are weaved or enmeshed and then subsequently completely or partially sulfonated.

In some embodiments, the non-woven mat, paper, or film made of carbon fibers contains only carbon fibers. In other embodiments, the non-woven mat or paper made of carbon fiber may or may not include other types of fiber (e.g., glass or metal), a bonding agent, a matrix (which may or may not also be composed of a form of carbon), or a coating on the carbon fibers.

In other aspects, the invention is directed to articles and devices in which the preform or non-woven mat or paper made of carbon fibers can be incorporated. Some examples of articles and devices in which the preform or non-woven mat or paper made of carbon fibers can be incorporated include structural composite materials, gas separation membranes, gas adsorption devices, water filtration and purification devices, water desalination devices, electrodes, catalysts, charge storage devices (e.g., capacitors and supercapacitors), smoke filters (e.g., cigarette filters), and high-strength and/or heat-resistant structural articles, moldings, and compositions, such as polymer, plastic, textile, fabric (e.g., a garment), cellulose (e.g., paper, wood, or cardboard), glass, metal, concrete, clay, and ceramic composites of the non-woven mat or paper made of carbon fibers.

The final high strength carbon fiber (and/or corresponding fiber precursor) can have any desired thickness (i.e., diameter). In different embodiments, the fiber can have a thickness of precisely, about, up to, less than, or above, for example, 0.05, 0.1, 0.2, 0.5, 1, 2, 5, 10, 15, 20, 30, 40, 50, 60, 70, 80, 90, or 100 microns, or a thickness within a range bounded by any two of these values. In some embodiments, the fiber is in the form of a tow, while in other embodiments the fiber is in the form of a single filament. Continuous filaments or tows from very low count (<500) to very high counts (>50k) are considered herein. Such fibers may also be stapled or chopped (i.e., short-segment or discontinuous).

The term "carbon", as used herein, refers to any form of carbon, including amorphous, graphitic, crystalline, and semi-crystalline forms of carbon. In some embodiments, the carbon fiber may have characteristics of a single type of carbon structure throughout the carbon fiber, while in other embodiments, the carbon fiber may have two or more types of carbon structure, e.g., a more pronounced graphitic structure on the outer surface of the carbon fiber and a more pronounced amorphous structure below the surface or in inner layers of the carbon fiber. Moreover, the term "carbon" includes fibers constructed of only elemental carbon (i.e., 100% carbon), or fibers constructed substantially of elemental carbon, generally at least 85%, 90%, 95%, 98%, or 99% elemental carbon. An element other than carbon, if included, is generally included in a dopant amount (e.g., up to or less than 10,000, 5,000, 1,000, 500, or 100 ppm). The element other than carbon can be, for example, silicon, nitrogen, boron, oxygen, sulfur, or phosphorus, or a combination thereof. The presence or absence of non-carbon elements is strongly dependent on the composition of the precursor fiber, and whether a doping gas (e.g., ammonia or oxygen) is included or excluded in the carbonization process. In preferred embodiments, the carbon fiber possesses at least some graphitic (i.e., ordered or crystalline) character in order to provide the high strength high modulus characteristics described herein.

The carbon fiber may also be non-porous or porous, for both solid and hollow carbon fibers. For carbon fibers that are porous, the porosity considered herein is a result of pores on outer and/or inner surfaces (or layers) of the carbon fiber, typically approximately perpendicular to the length of the fiber or substantially non-parallel to the length of the fiber. For a solid (i.e., non-hollow) carbon fiber, the pores may be on the outer surface (or core segments), and for hollow carbon fibers, the pores may be on the inner surface (i.e., surrounding hollow core). In embodiments where the filaments are made from an already-sulfonated precursor at the core surrounded by a sheath of unsulfonated polymer, a porous structure can be created on the outer layer or surface. The pores may be mesopores, micropores, or macropores, or a combination thereof. Generally, for hollow carbon fibers, the pores are substantially smaller than the diameter of the hollow core (e.g., no more than 5%, 10%, or 20% of the hollow core diameter).

As used herein and as understood in the art, the terms "mesopores" and "mesoporous" refer to pores having a size (i.e., pore diameter or pore size) of at least 2 nm and up to 50 nm, i.e., "between 2 and 50 nm", or "in the range of 2-50 nm". In different embodiments, the mesopores have a size of precisely or about 2 nm, 2.5 nm, 3 nm, 3.5 nm, 4 nm, 4.5 nm, 5 nm, 5.5 nm, 6 nm, 6.5 nm, 7 nm, 7.5 nm, 8 nm, 8.5 nm, 9 nm, 9.5 nm, 10 nm, 11 nm, 12 nm, 15 nm, 20 nm, 25 nm, 30 nm, 35 nm, 40 nm, 45 nm, or 50 nm, or a particular size, or a variation of sizes, within a range bounded by any two of these values.

As used herein and as understood in the art, the terms "micropores" and "microporous" refer to pores having a diameter of less than 2 nm. In particular embodiments, the micropores have a size of precisely, about, up to, or less than 0.5, 0.6, 0.7, 0.8, 0.9, 1.0, 1.1, 1.2, 1.3, 1.4, 1.5, 1.6, 1.7, 1.8, or 1.9 nm, or a particular size, or a variation of sizes, within a range bounded by any two of these values. In some embodiments, the microporous carbon fiber is further surface activated by methods known in the art (e.g., burn out by carbon dioxide, or treatment with alkali followed by heat treatment) to produce high surface area activated carbon fibers.

As used herein, the terms "macropores" and "macroporous" refer to pores having a size of at least 60 mu Generally, the macropores considered herein have a size up to or less than 1 micron (1 μm). In different embodiments, the macropores have a size of precisely, about, at least, or greater than 60 nm, 65 nm, 70 nm, 75 nm, 80 nm, 85 nm, 90 nrn, 95 nm, 100 nm, 110 nm, 120 nm, 130 nm, 140 nm, 150 nm, 160 nm, 170 nm, 180 nm, 190 nm, 200 nm, 225 nm, 250 nm, 275 nm, 300 nm, 325 nm, 350 nm, 375 nm, 400 nm, 425 nm, 450 nm, 475 nm, 500 nm, 550 nm, 600 nm, 650 nm, 700 nm, 750 nm, 800 nm, 850 nm, 900 nm, 950 nm, or 1000 nm, or a particular size, or a variation of sizes, within a range bounded by any two of these values.

The carbon fiber or non-woven mat or paper form thereof may also have any suitable surface area, which is very much affected by the level of porosity. In different embodiments, the carbon fiber or non-woven mat or paper form thereof may have a surface area of precisely, about, at least, greater than, or up to, for example, 5 $m^2/g$, 10 $m^2/g$, 15 $m^2/g$, 20 $m^2/g$, 30 $m^2/g$, 40 $m^2/g$, 50 $m^2/g$, 60 $m^2/g$, 70 $m^2/g$, 80 $m^2/g$, 90 $m^2/g$, 100 $m^2/g$, 150 $m^2/g$, 200 $m^2/g$, 250 $m^2/g$, 300 $m^2/g$, 350 $m^2/g$, 400 $m^2/g$, 450 $m^2/g$, 500 $m^2/g$, 600 $m^2/g$, 700 $m^2/g$, 800 $m^2/g$, 900 $m^2/g$, 1500 $m^2/g$, 2000 $m^2/g$, 2500 $m^2/g$, or 3000 $m^2/g$, or a surface area within a range bounded by any two of the foregoing values. Hollow filaments made from partially sulfonated filaments of polyolefins with sulfonated sheath and non-sulfonated core can have exceptionally high surface areas by virtue of the porous inner surface or porous core.

The carbon fiber produced after the controlled stabilization and carbonization process described above is preferably a high strength and/or high modulus carbon fiber. The tensile strength of the carbon fiber is generally at least 150 kilopounds per square inch (150 ksi), which corresponds to approximately 1 GPa. In different embodiments, the carbon fiber has a tensile strength of precisely, about, at least, or greater than, for example, 150, 200, 250, 300, 350, 400, 450, 500, 550, 600, 650, 700, 750, 800, 850, 900, 950, 1000, 1100, 1200, 1300, 1400, or 1500 ksi, (which corresponds to approximately to 1-10 GPa) or a tensile strength within a range bounded by any two of the foregoing exemplary values. The elastic (i.e., tensile) modulus of the carbon fiber is generally at least 15 megapounds per square inch (15 Msi), which corresponds to approximately 100 GPa. In different embodiments, the carbon fiber has an elastic modulus of precisely, about, at least, or greater than, for example, 15, 20, 25, 30, 35, 40, 45, 50, 55, 60, 65, 70, 75, 80, 85, 90, 95, 100, 110, 120, 130, 140, or 150 Msi (which corresponds to approximately 100-1000 GPa), or an elastic modulus within a range bounded by any two of the foregoing exemplary values. The ultimate elongation (i.e., "elongation at break" or "elongation") of the carbon fiber is generally at least 0.5%. In different embodiments, the carbon fiber exhibits an elongation of precisely, about, at least, or greater than, for example, 0.5%, 0.8%, 1%, 1.5%, 1.8%, 2%, 2.2%, or 2.5%, or an elongation within a range bounded by any two of the foregoing exemplary values. The carbon fiber may also possess a thermal conductivity of at least, above, up to, or less than, for example, 0.1, 1, 10, 50, 100, 150, 200, 250, 300, 350, 400, 500, 1000, 1500, 2000, or 2500 W/m-K.

Examples have been set forth below for the purpose of illustration and to describe certain specific embodiments of the invention. However, the scope of this invention is not to be in any way limited by the examples set forth herein.

EXAMPLES

Preparation of Linear Low Density Polyethylene (LLDPE) Fibers

LLDPE fibers were spun from neat resin using a conventional melt extrusion method. Melt-spinning of the resin at 220° C. through a 288-hole spinneret gave a spun-drawn tow of filaments with 18-micrometer diameters (Sample 1). To get smaller diameter filaments of LLDPE, a bicomponent spinning process was used. A sheath-core filament with LLDPE core and polylactic acid (PLA) sheath was spun. The spinneret head assembly was maintained at 230° C., the PLA extruder was maintained at 200-230° C., and the LLDPE extruder was run at 190-220° C.

The PLA sheath was washed in a THF bath at 50° C. with a 30 minute residence time. After washing of the sheath component, LLDPE fibers (288 filaments) of 10 micrometer diameters were obtained. The fiber was not drawn to an appreciable extent primarily because of the inability to impart significant axial stress onto the molten LLDPE core. The sheath component solidified quickly and withstood the major elongational stress, thereby producing mostly undrawn LLDPE fiber of 10 micrometer diameters (Sample 2). The tows were combined and the resulting fiber stretched through a tubular oven at 80° C. for 50% stretching and simultaneous annealing of the fiber. The resulting fibers were 8-9 micrometer in diameter. The fibers from Sample 2 could be stretched more than 150% at 80° C. to get filaments of 7 micrometer diameter. The tensile stress-strain profiles of the fibers (Samples 1 and 2) are displayed in FIG. 1.

Controlled Sulfonation

Polyethylene (PE) fibers can be sulfonated by various chemical agents, including fuming sulfuric acid (oleum), chlorosulfonic acid, and sulfuric acid. Regardless of the type of sulfonating agent, the degree of sulfonation is a key factor. Partially sulfonated polyethylene fibers generally do not result in carbon fibers with good mechanical properties. However, as devised herein, the purpose of sulfonation is not only to make the plastic fiber infusible but also to render it tolerant to axial stress so that during heat treatment or carbonization it can form an aligned graphitic structure as evidenced by a high modulus in carbonized filaments.

Oleum-Based Sulfonation

Figure 2:
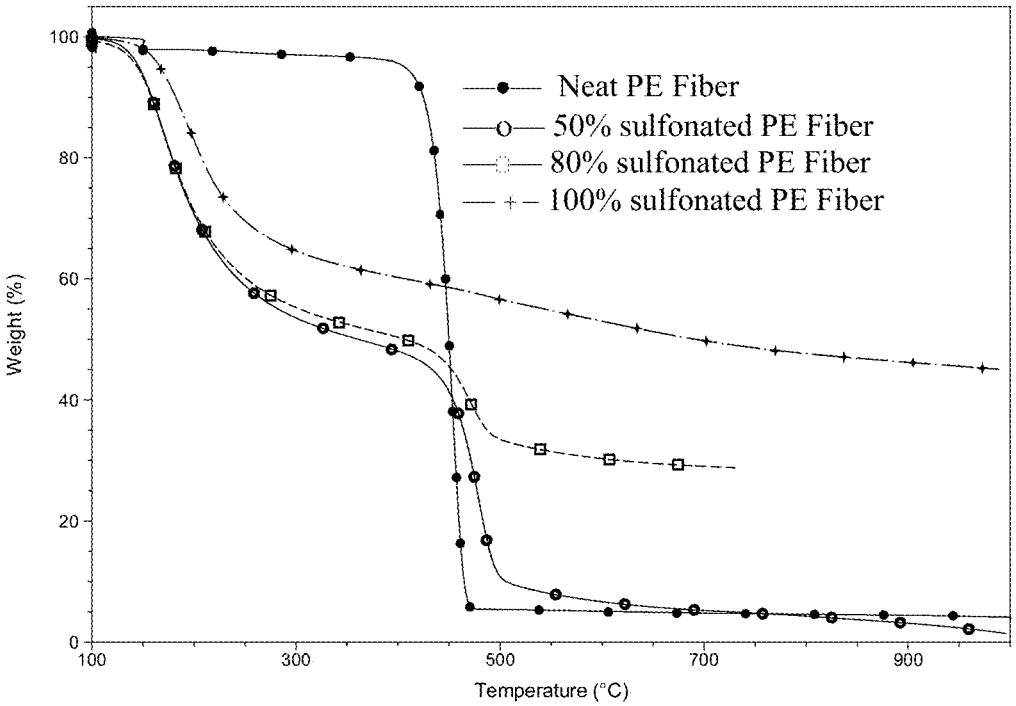
FIG. 2. TGA thermograms of neat and sulfonated PE fibers when sulfonation was conducted in fuming sulfuric acid or oleum containing 16% $SO_3$.

Continuous sulfonation of the Sample 2 using oleum of 16% SO3 content at 70° C. and 5 MPa axial-stress for a 15-minute residence time, resulted in 15% sulfonation and 2% stretch in the fiber. Similar conditions at 30- and 90-minute residence times resulted in 50% and 80% sulfonated fibers, respectively. A 7-hour residence time resulted in a 100% sulfonated fiber. Thermogravimetric analysis of the representative samples are displayed in FIG. 2. A longer residence time resulted in a higher degree of sulfonation, which was measured based on the mass loss within the first 300° C. relative to the total sulfonated and unsulfonated PE fractions. The unsulfonated PE fraction usually shows a mass loss at 450-480° C., which corresponds to the decomposition temperature of PE. FIG. 2 suggests a higher degree of sulfonation is necessary for significant char or carbon yield. Further, it can be observed that the decomposition rate of the sulfonated PE fraction (i.e., rate of desulfonation) in these samples decreased at high residence times or for more highly sulfonated samples. For example, the desulfonation peak for the 7-hour residence time sample is found at 195° C. The same peaks for 30- and 90-minute residence time samples were found at 168° C. and 170° C., respectively.

Controlled washing of oleum-treated fibers in water is not possible, as the heat of dilution of fuming sulfuric acid causes rapid hydrothermal carbonization, which leads to a brittle glassy carbon filament prone to breakage. Therefore, washing of oleum-treated fibers in concentrated sulfuric acid of gradually decreased strength is preferred.

It was very difficult to control the filament orientation during thermal desulfonation or gradual washing of sulfonated fibers. The best protocol involving conversion of these fibers with a degree of sulfonation greater than 50% to carbon fiber, under tension and without filament breakage, achieved carbonized fibers with 100-150 ksi tensile strength and 10-15 Msi modulus with 1% ultimate elongation.

Figure 3A:
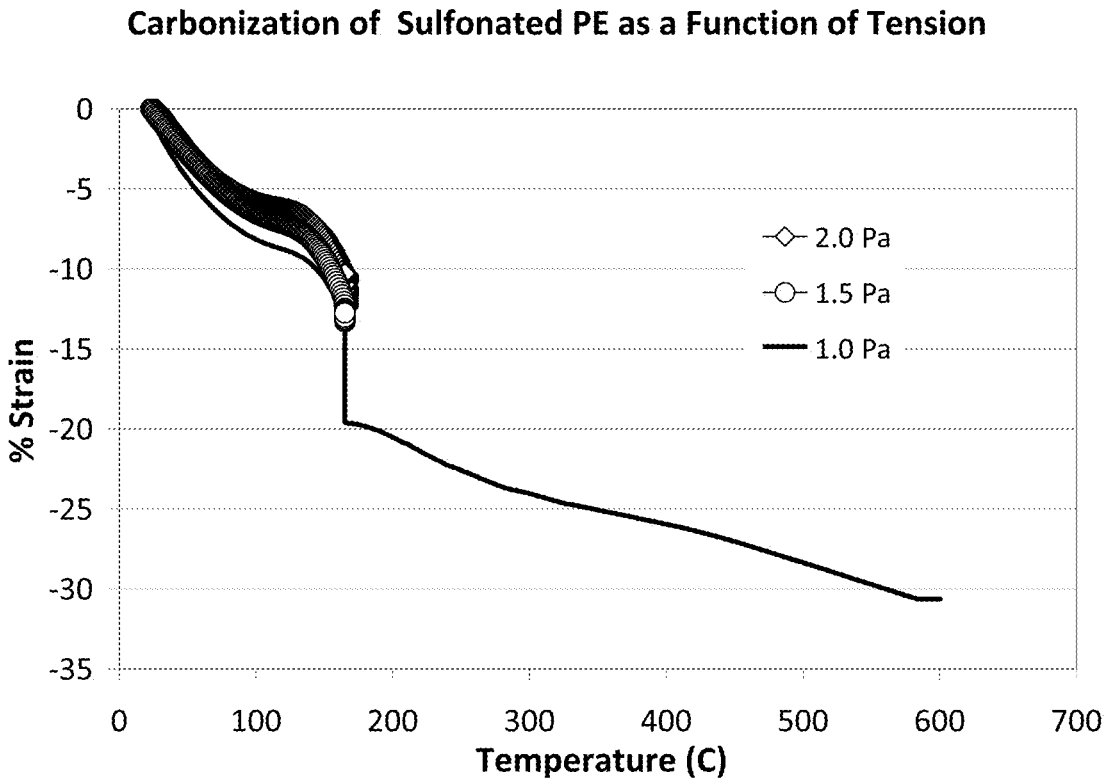
FIGS. 3A, 3B. Graphs showing thermomechanical analysis of a sulfonated PE fiber sample (Sample 1; 80% sulfonation): strain vs. temperature data (FIG. 3A) and strain vs. time data (FIG. 3B). The scan was conducted at a heating ramp rate of 10° C./min, and a residence time of 10 minutes was applied at 165° C., where the desulfonation reaction rate appeared maximal through observation of peak mass loss rate in thermogravimetric analysis.
Figure 3B:
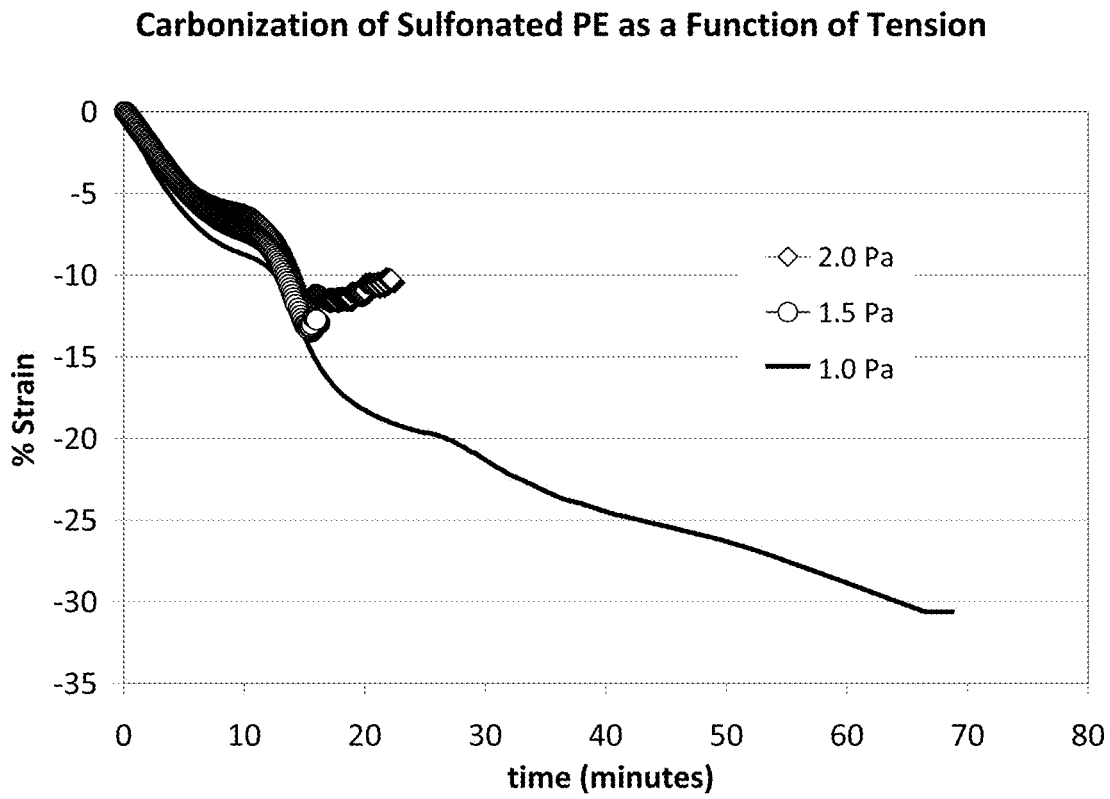

Precursor fibers were typically found to have a modulus of 0.02 to 0.10 Msi depending on the draw-down ratio of as-spun fibers. Simple sulfonated fibers obtained by oleum treatment at 90-minute residence time (i.e., 80% sulfonation) exhibited significant reduction in ductility (ultimate elongation 10-25%) and slight increase in modulus (0.2 Msi). The axial stress of these sulfonated fibers was monitored during the desulfonation step using a thermomechanical analyzer where a tension was applied to the loaded fiber, and the temperature of the environment was controlled at a heating rate of 10° C./min. As displayed in FIGS. 3A and 3B, the fibers usually shrunk during the desulfonation step, and thus, an effort was made to counterbalance the shrinkage stress by an applied stress. When the applied stress was higher than the shrinkage stress, the fibers broke. FIGS. 3A and 3B suggest that 1 Pa is a tolerable stress to cause almost 30% shrinkage. However, an increased stress causes filament breakage. During the isothermal condition at 165° C. for 10 minutes, a slight elongation of the filament was observed at high stress before breakage.

The results suggest that the fibers are very week when sulfonated by the oleum method. For this reason, a more controlled sulfonation was investigated in an effort to improve filament rigidity.

Since oleum treatment accelerates the degree of sulfonation (by virtue of the presence of $SO_3$ gas) compared to other sulfonation methods, and a direct washing of the fibers in water could not be performed due to significant heat of dilution, a fiber tow was treated in a continuous process wherein concentrated sulfuric acid was applied immediately after the oleum sulfonation. More specifically, a multi-step sulfonation method was investigated in which a first preliminary sulfonation was conducted in fuming sulfuric acid followed by treatment in concentrated sulfuric acid, and this followed by washing in dilute acid and then deionized water. In some cases, oleum treatment was eliminated altogether, with sulfonation conducted in concentrated sulfuric acid, followed by a slow sulfonation reaction.

Sulfonation by Concentrated Sulfuric Acid

Figure 4:
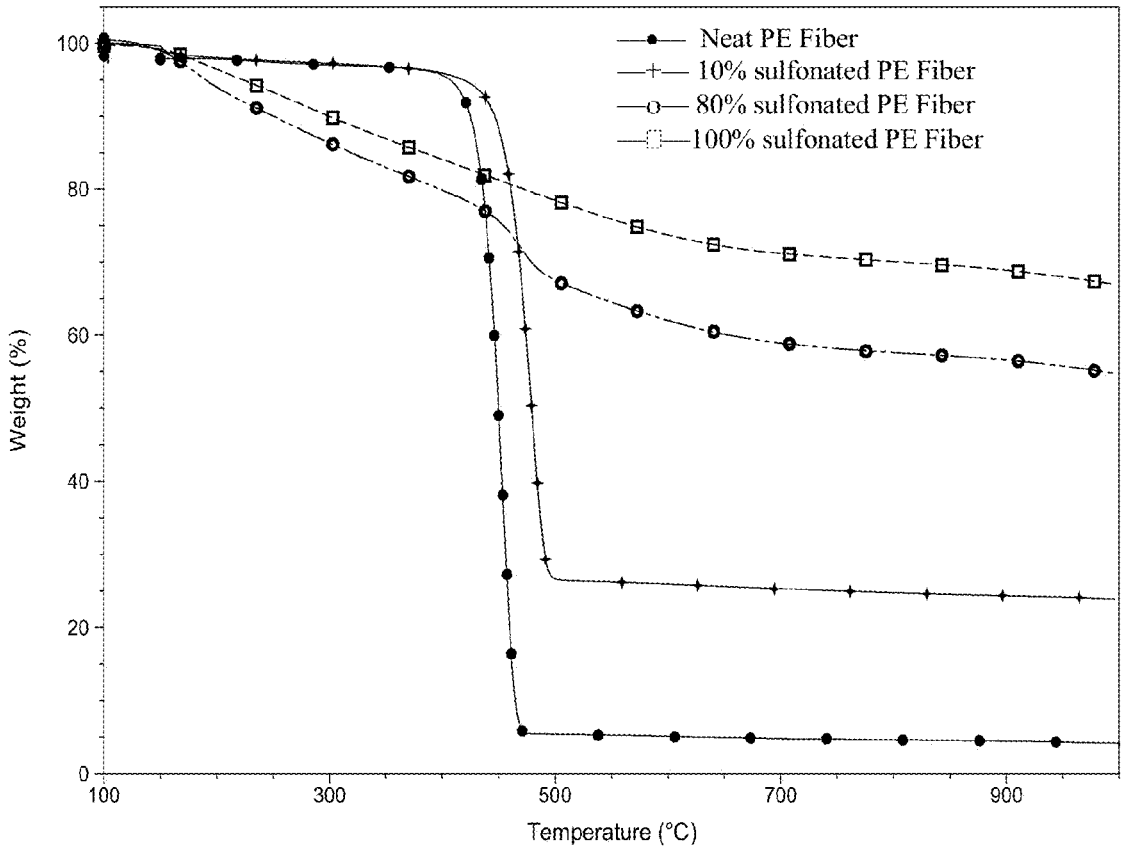
FIG. 4. TGA thermograms of neat and sulfonated PE fibers when sulfonation was conducted in 98% concentrated sulfuric acid at 120° C. 10% sulfonation was achieved for a 4.5 hour sulfonation at 0.2 MPa stress, which led to 7% shrinkage. 80% sulfonation was achieved for a 6 hour sulfonation at 2 MPa stress, which led to 18% shrinkage. 100% sulfonation was achieved for a 15 hour sulfonation at 5.4 MPa stress, which led to 4% shrinkage.

Thermally drawn or stretched fibers of Sample 2 (10 combined tows of 288 filaments in each tow) were sulfonated continuously in concentrated sulfuric acid (95-98%) at 120° C. and an applied axial stress of 0.2-6 MPa (20-550 g load applied to fiber going through a sulfonation bath). A series of sulfonation reactions in conc. sulfuric acid along with kinetic experiments were performed. The TGA thermograms of the representative samples are displayed in FIG. 4. A shown, with increase in degree of sulfonation the carbon yield at high temperature increased significantly. As further shown, at high degree of sulfonation, the desulfonation rate (of residual sulfonated groups) as measured by mass loss rate with unit rise in temperature (slope of the curve) decreased.

Figure 5:
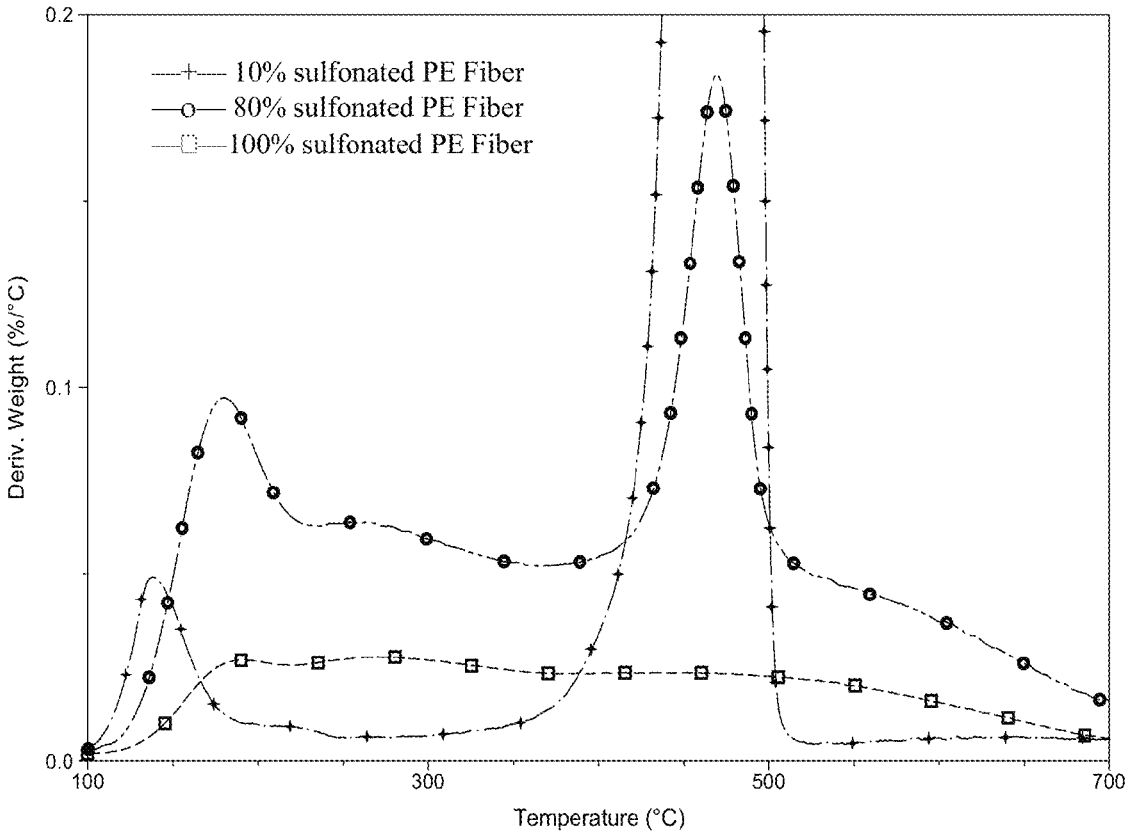
FIG. 5. Graph showing derivative thermogravimetric (DTG) analysis of sulfonated PE fibers of different degrees of sulfonation (10%, 80%, and 100%) when sulfonation was conducted in 98% concentrated sulfuric acid at 120° C.

FIG. 5 shows the results of derivative thermogravimetric (DTG) analysis of sulfonated PE fibers of different degrees of sulfonation when sulfonation was conducted in 98% concentrated sulfuric acid at 120° C. As shown by the DTG data in FIG. 5, the highly sulfonated sample (processed for 15 hours) exhibited a very broad decomposition peak ranging from 170-500° C. with multiple local maxima at 189° C., 268° C., and 486° C., that can be assigned to the residual desulfonation, volatilization of desulfonated derivatives, and decomposition of a minor fraction of unsulfonated PE residue in the fiber. When the processing time was less (6 hours), the decomposition contribution of the desulfonated derivative was low. This may indicate that the fibers during desulfonation form an intermediate derivative that is critical for providing high strength fibers. Such a desulfonated mass that exhibits a thermal decomposition at an intermediate temperature range is herein considered to be a pre-carbonized derivative. Significantly, such an intermediate peak was not present when the fibers were sulfonated in oleum and not much aqueous heat treatment was conducted. A DTG plot of the TGA data provided in FIG. 2 is displayed in FIG. 6. As shown, the DTG plot indicates a clear valley between peaks for desulfonation and decomposition of PE. The valley (in the range of 250 to 425° C.) confirms insignificant formation of a pre-carbonized derivative that should have a peak around 270 to 300° C.

Figure 6:
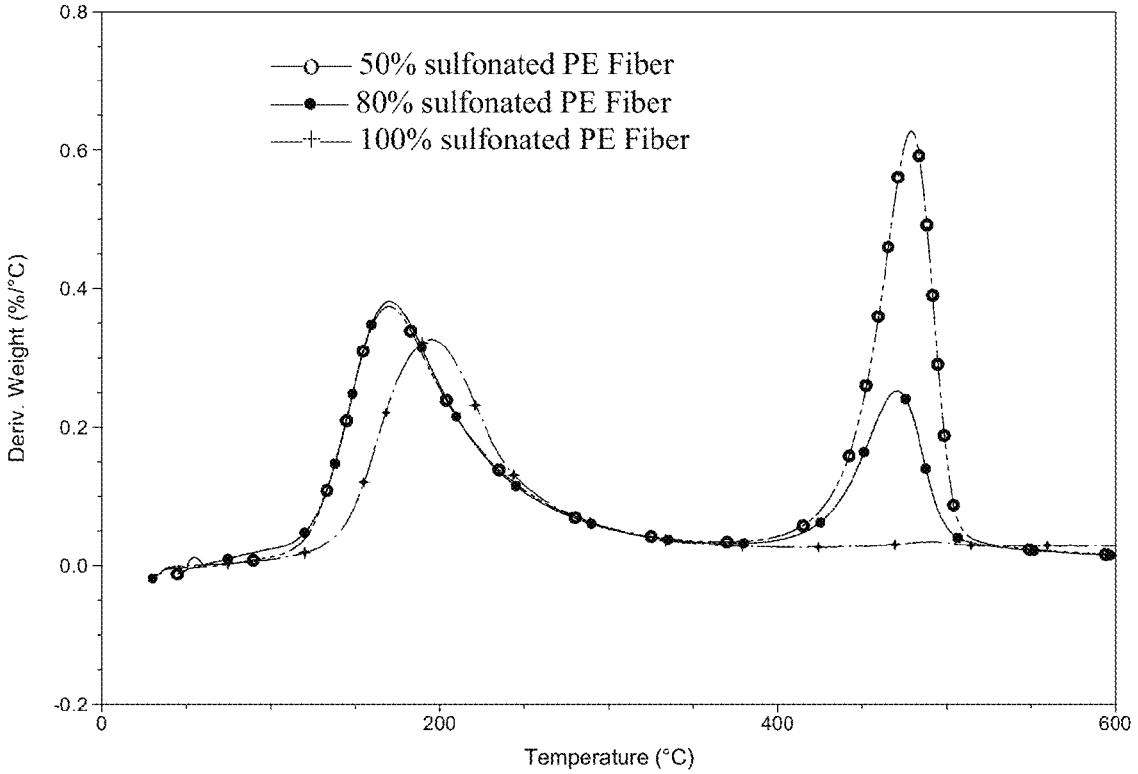
FIG. 6. Graph showing derivative thermogravimetric (DTG) analysis of sulfonated PE fibers of different degrees of sulfonation (50%, 80%, and 100%) when sulfonation was conducted in 16% $SO_3$-containing fuming sulfuric acid (oleum) at 70° C.

Thus, as contrasted by FIGS. 5 and 6, the oleum-based sulfonation did not result in derivatives that undergo decomposition at higher temperature (>200° C.). The resulting carbon fibers, as produced after high temperature carbonization, do not possess a high graphitic content and do not have sufficient strength for many applications.

In view of the above, an improved process has herein been developed to produce carbon fibers exhibiting high strength and significant resistance to deformation. The process employs a controlled pre-carbonization step in which a sulfonation-desulfonation equilibrium is achieved at high temperature while tension is applied to the fiber. Such a pre-carbonized derivative would indicate its presence in a DTG curve by exhibiting a mass loss peak at an intermediate temperature range (250 to 400 ° C.) with very little actual mass loss (<15%) and high carbon yield at high temperature.

A chemical modeling and simulation study suggests that free radical desulfonation occurs at relatively lower temperature, which leads to a trans-olefin structure. In the absence of free radicals, the decomposition follows a cyclic transition state involving direct elimination of sulfurous acid, which leads to a cis-olefin structure. Aqueous phase high temperature treatment substantially or completely eliminates the possibility of free radical formation, particularly as aqueous phase functions as a media or solvent-based free radical terminator. Thus, aqueous phase (conc. $H_2SO_4$) desulfonation seems to be the key to forming intermediate desulfonated products. The process took a longer time in conc. $H_2SO_4$ as low temperature (120° C.) was maintained. Ideally, the temperature should be increased to a higher temperature up to or below the boiling temperature of conc. $H_2SO_4$. Early stage low temperature sulfonation (120° C.) makes the fiber gradually tolerant to higher temperature. Thus, the sulfonation bath should have a gradient of temperature ranging from 120° C. (just below the melting temperature of PE fibers) to just under the boiling point of conc. $H_2SO_4$.

Carbonization Process, and Properties of Carbonized Fibers

Figure 7:
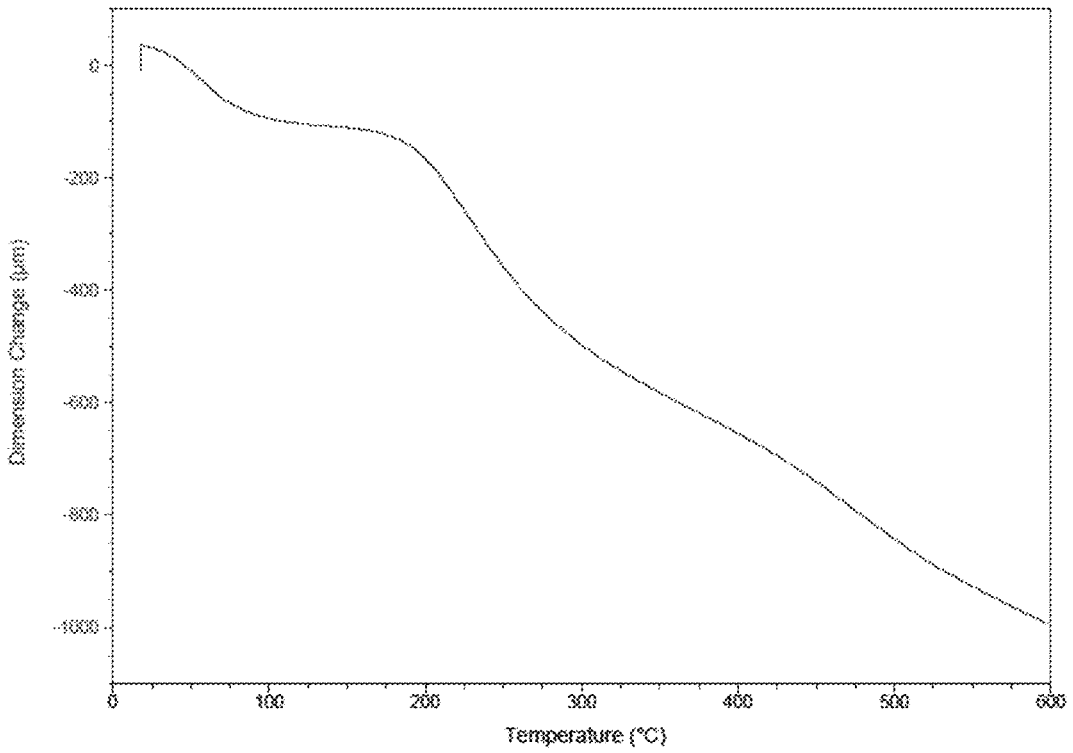
FIG. 7. TMA carbonization profile for 80% sulfonated PE (Sample 2) made via concentrated sulfuric acid route under 10 MPa axial stress. Sample length is ~8 mm, which means that total shrinkage is approximately 12%. The hump at 200° C. corresponds to residual desulfonation and completion of pre-carbonization step.

The sulfonated fibers from concentrated sulfuric acid with 80% or higher degree of sulfonation could be carbonized at higher axial stress (an order of magnitude larger stress than that tolerated by oleum-sulfonated fibers), e.g., 10 MPa. Without being bound by theory, it is believed that the pre-carbonized moieties (or the condensed cyclized derivatives from cis-olefins) are responsible for stress resistance and graphitic structure formation. FIG. 7 shows the results of a thermomechanical analysis (TMA) on such a sulfonated fiber. The fiber usually gets carbonized by 600° C. and the higher temperature treatments cause growth and alignment of graphitic structure along the direction of applied stress. Based on the TMA data of FIG. 7, Sample 2 can be carbonized to 600° C. (practical temperature limit of the instrument) under at least 10 MPa of carbonization stress. However, TMA carbonization is highly idealized because the heating rate is 10° C./min (compared to >100 ° C./min through tube furnaces) and the samples are held between grips without any knots. In an actual carbonization of 12" long samples, knots are used to splice the sample and carbonized continuously through the tubular furnace. The highest stress that could be maintained during carbonization of 12" long filament bundle spliced with carrier tow, through the tube furnaces, was 7.7 MPa.

Figure 8:
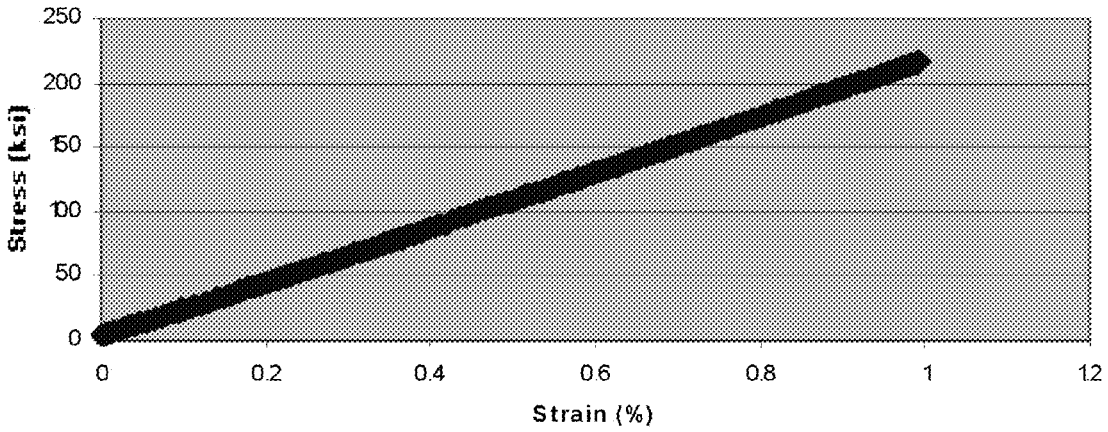
FIG. 8. Graph showing stress-strain profile of a PE-based carbon fiber.
Figure 9:
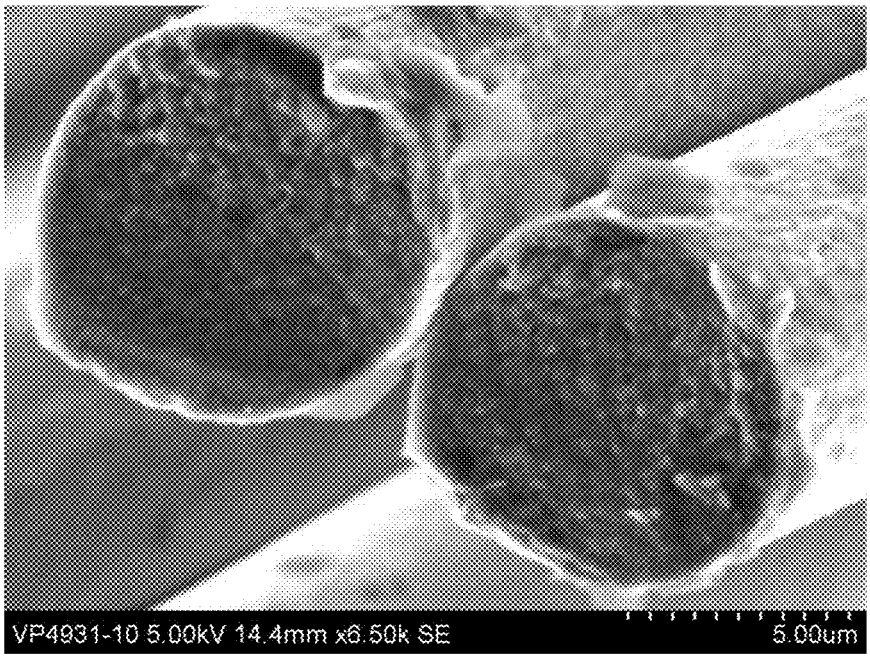
FIG. 9. Scanning electron micrograph of a carbonized filament cross-section.

Stepwise heat treatment of sulfonated fibers was conducted in different furnaces up to 2400 ° C. A two-minute residence time was applied in each of the three heat treatment steps, i.e., 300-700° C., 700-1200° C., and 2400° C. A sample that experienced 30% shrinkage during sulfonation under 2 MPa stress in conc. $H_2SO_4$ for 6 hours was carbonized under similar tension. After high temperature (2400° C.) carbonization, 6.7-micron carbonized filaments were obtained. Based on the applied tension, the axial stress corresponds to 3.6 MPa. At this stage, the filaments experienced a slight extension during carbonization. Overall, the fibers experienced a 4% elongation during the high temperature conversion. A representative stress-strain profile of such a filament is shown in FIG. 8. The stress-strain profile shows elastic deformation until failure and follows Hook's law. The fiber has 1% elongation and 210 ksi tensile strength. The fiber batch exhibited an average of 22 Msi modulus and 201 ksi strength with 0.9% ultimate elongation. A scanning electron micrograph of the failed fiber cross section is shown in FIG. 9. Micro-roughness on the failed fiber cross-section suggests high energy of rupture. A glassy amorphous carbon usually shows a flat and smooth failed surface on the fiber cross-section.

Figure 10A:
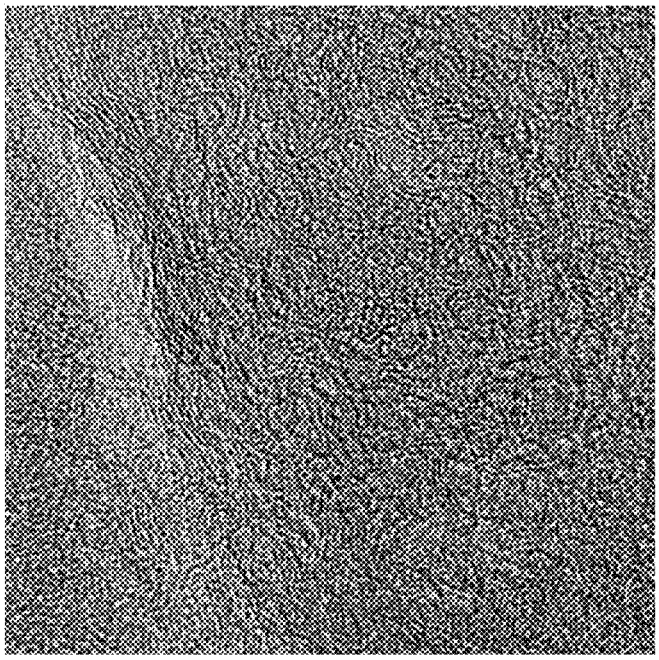
FIGS. 10A, 10B. Transmission electron micrograph (TEM) of fiber carbonized from controlled sulfonation and carbonization (FIG. 10A) and TEM of the fiber obtained from rapid oleum-based processing in which controlled desulfonation was not conducted prior to low temperature and high temperature carbonization (FIG. 10B).
Figure 10B:
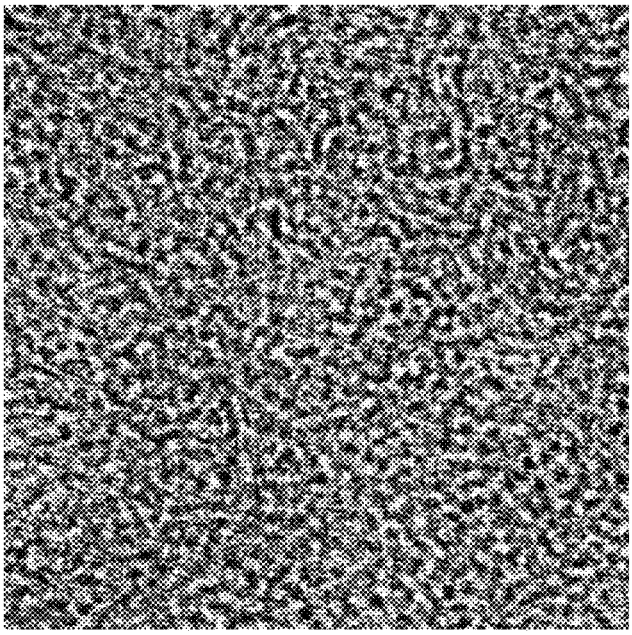

A TEM micrograph from cross-section of a carbon fiber resulting from controlled sulfonation and subsequent carbonization is displayed in FIG. 10A. A TEM micrograph from cross-section of a carbon fiber resulting from rapid (i.e., uncontrolled) oleum-based sulfonation and subsequent carbonization (without treating it through sulfonation-desulfonation equilibrium) is displayed in FIG. 10B, which indicates relatively more porous and disordered carbon.

Figure 11:
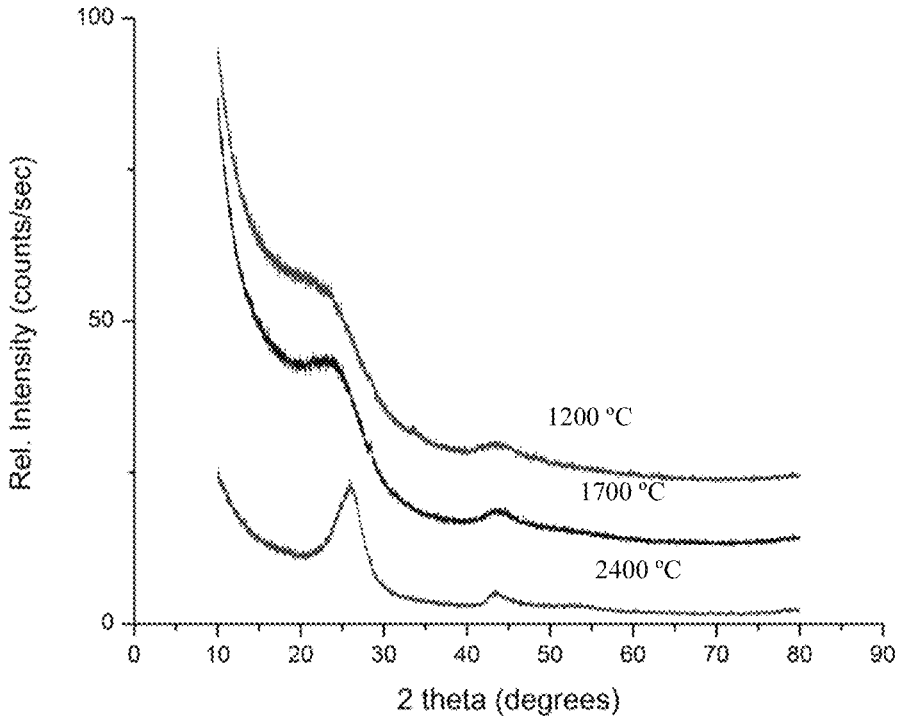
FIG. 11. 2-theta profiles of different heat-treated carbon fibers from their x-ray diffraction (XRD) patterns.

FIG. 11 shows the 2-theta profile obtained from an x-ray diffraction pattern of the oleum-treated PE-based carbon fibers obtained at 1200° C., 1700° C., and 2400° C. The results of FIG. 11 show that, with increase in temperature, the (002) peak due to graphitic order sharpens. The instant results reveal that a very high temperature carbonization of PE-based precursor is generally necessary to achieve a high strength carbon fiber, unless a sulfonation-desulfonation and aqueous acid catalyzed pre-carbonization process, as described above, was employed prior to a low temperature carbonization.

While there have been shown and described what are at present considered the preferred embodiments of the invention, those skilled in the art may make various changes and modifications which remain within the scope of the invention defined by the appended claims.

What is claimed is:

1. A method for the preparation of carbon fiber from a sulfonated polyvinyl precursor fiber having sulfonic acid groups thereon, the method comprising:

(i) immersing the sulfonated polyvinyl precursor fiber into a liquid solution comprised of an ionic liquid solvent and a solute species capable of engaging in an elimination-addition equilibrium with said sulfonic acid groups, wherein said ionic liquid solvent has a boiling point of at least 350° C.;

(ii) heating said liquid solution, after said sulfonated polyvinyl precursor fiber has been immersed therein, to a first temperature of at least 25° C. at which said sulfonated polyvinyl precursor fiber engages in an elimination-addition equilibrium between said sulfonic acid groups and said liquid solution while the sulfonated polyvinyl precursor fiber is maintained at an applied tension of at least 0.1 MPa;

(iii) gradually raising said first temperature to a final temperature of at least 300° C. at an average temperature ramp rate of up to 50° C. per minute, wherein said final temperature is at least 20° C. above the first temperature and up to the boiling point of the liquid solution for sufficient time to convert said sulfonated polyvinyl precursor fiber to a pre-carbonized fiber; and (iv) subjecting the pre-carbonized fiber produced according to step (iii) to a high temperature carbonization process to produce said carbon fiber, wherein said high temperature carbonization process is conducted at a temperature of at least 500° C.

2. The method of claim 1, wherein said sulfonated polyvinyl precursor is sulfonated polyolefin precursor.

3. The method of claim 1, wherein said first temperature at which said polyvinyl precursor fiber engages in said elimination-addition equilibrium is at least 50° C.

4. The method of claim 1, wherein said first temperature at which said polyvinyl precursor fiber engages in said elimination-addition equilibrium is at least 120° C.

5. The method of claim 1, wherein said first temperature at which said polyvinyl precursor fiber engages in said elimination-addition equilibrium is at least 150° C.

6. The method of claim 1, wherein said applied tension is at least 1 MPa.

7. The method of claim 1, wherein said applied tension is at least 2 MPa.

8. The method of claim 1, wherein said applied tension is at least 5 MPa.

9. The method of claim 1, wherein said first temperature is raised to said final temperature at an average temperature ramp rate of up to 20° C. per minute.

10. The method of claim 1, wherein said first temperature is raised to said final temperature at an average temperature ramp rate of up to 10° C. per minute.

11. The method of claim 1, wherein said first temperature is raised to said final temperature at an average temperature ramp rate of up to 5° C. per minute.

12. The method of claim 1, wherein said final temperature is at least 40° C. above said first temperature and up to the boiling point of the liquid solution.

13. The method of claim 1, wherein said final temperature is at least 70° C. above said first temperature and up to the boiling point of the liquid solution.

14. The method of claim 1, wherein said pre-carbonized fiber is infusible and incombustible.

15. The method of claim 1, wherein said liquid solution includes at least one free-radical scavenger.

16. The method of claim 15, wherein said free-radical scavenger is selected from hindered phenols, thioesters, phosphites, and aromatic amines.

17. The method of claim 1, wherein steps (i) to (iii) are conducted as a continuous process on a continuously fed precursor fiber.

18. The method of claim 1, wherein steps (i) to (iii) are conducted as a batch process on batch-fed precursor fiber.

19. The method of claim 1, wherein said sulfonated polyvinyl precursor fiber having sulfonic acid groups thereon is produced from non-functionalized precursor fiber in a separate step before step (i), or is produced from non-functionalized precursor fiber during step (i) or during steps (i) and (ii).

20. The method of claim 1, wherein said high temperature carbonization process is conducted at a temperature of at least 1000° C.

21. The method of claim 1, wherein said high temperature carbonization process is conducted at a temperature of at least 2000° C.

22. The method of claim 1, wherein said high temperature carbonization process is conducted at a temperature of at least 2500° C.

23. The method of claim 1, wherein said carbon fiber has a tensile strength of at least 200 ksi.

24. The method of claim 1, wherein said carbon fiber has a modulus of at least 20 Msi.

25. The method of claim 1, wherein said carbon fiber has an ultimate elongation of at least 0.5%.

26. The method of claim 1, wherein said carbon fiber has an ultimate elongation of at least 0.8%.

27. The method of claim 1, wherein said carbon fiber has a surface area of at least 1000 $m^2/g$.

28. The method of claim 1, wherein said carbon fiber is processed in spoolable filament web or mat form.

29. The method of claim 1, wherein, directly prior to step (i), the sulfonated polyvinyl precursor fiber is produced by treating an unsulfonated precursor fiber in oleum.

30. The method of claim 1, wherein said final temperature is at least 350° C.

31. The method of claim 1, wherein said ionic liquid solvent has a boiling point of at least 400° C.

32. The method of claim 31, wherein said final temperature is at least 400° C.

33. The method of claim 1, wherein said solute is a salt of a strong mineral acid.

34. The method of claim 33, wherein said salt is ammonium sulfate.

* * * * *